US010372066B2

(12) United States Patent
Taniguchi et al.

(10) Patent No.: US 10,372,066 B2
(45) Date of Patent: Aug. 6, 2019

(54) IMAGE FORMING APPARATUS

(71) Applicant: CANON KABUSHIKI KAISHA, Tokyo (JP)

(72) Inventors: Koichi Taniguchi, Tokyo (JP); Jun Nakazato, Noda (JP); Jiro Shirakata, Chigasaki (JP); Shusuke Miura, Toride (JP); Kana Oshima, Ako (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/645,950

(22) Filed: Jul. 10, 2017

(65) Prior Publication Data

US 2018/0017903 A1 Jan. 18, 2018

(30) Foreign Application Priority Data

Jul. 12, 2016 (JP) ..... 2016-137955
Jul. 13, 2016 (JP) ..... 2016-138748
Jul. 13, 2016 (JP) ..... 2016-138754

(51) Int. Cl.
*G03G 15/16* (2006.01)
*G03G 15/00* (2006.01)

(52) U.S. Cl.
CPC ..... *G03G 15/1615* (2013.01); *G03G 15/5008* (2013.01)

(58) Field of Classification Search
CPC ..... G03G 15/1615
See application file for complete search history.

(56) References Cited

U.S. PATENT DOCUMENTS

2014/0003827 A1* 1/2014 Arimura ..... G03G 21/0011 399/43
2015/0145454 A1* 5/2015 Kameyama ..... H02P 6/186 318/400.32
2015/0362867 A1 12/2015 Okumura
2017/0045857 A1* 2/2017 Hirai ..... G03G 21/0094
2018/0017915 A1* 1/2018 Ishikawa ..... G03G 15/0163

* cited by examiner

*Primary Examiner* — G.M. A Hyder
(74) *Attorney, Agent, or Firm* — Canon U.S.A., Inc. IP Division

(57) ABSTRACT

An image forming apparatus includes an image forming unit having a photosensitive member on which an image is formed and a developer bearing member, an intermediate transfer member onto which the image is transferred, a transfer member forming a nip portion for transfer of the image on the photosensitive member onto the intermediate transfer member, a transfer unit transferring the image on the intermediate transfer member onto the sheet, a motor rotating the photosensitive member, a motor control unit controlling the motor so the rotation speed of the photosensitive member is a target rotation speed, and a controller that acquires first and second load information of the photosensitive member in a first period where developer bearing member rotates and a second period where developer bearing member is stopped, and controls whether or not to change the target rotation speed based on the first and second load information.

37 Claims, 20 Drawing Sheets

IMAGE FORMING APPARATUS

BACKGROUND OF THE INVENTION

Field of the Invention

The present invention relates to speed control of an image bearing member in an image forming apparatus that forms images on the image bearing member.

Description of the Related Art

Electrophotography image forming apparatus form an electrostatic latent image on an image bearing member, and form an image by developing the electrostatic latent image using a developing agent. The developed image on the image bearing member is temporarily transferred to an intermediate transfer member, and thereafter the image on the intermediate transfer member is transferred to a sheet.

It is required of an image forming apparatus to control the speed (surface speed) of the surface of the image bearing member moving, and the speed (surface speed) of the surface of the intermediate transfer member moving, to a constant speed. The reason is that a laser beam for developing the electrostatic latent image on the image bearing member scans the image bearing member at a predetermined timing. In a case where the surface speed of the image bearing member changes, for example, the length of the image might change due to change in the pitch of scanning lines, and variance in density might occur in the image on the image bearing member. Accordingly, image forming apparatuses executed feedback control based on output of an encoder for example, to control the surface speed of the image bearing member and the surface speed of the intermediate transfer member.

Now, even if the surface speed of the image bearing member and the surface speed of the intermediate transfer member can be controlled to a constant speed, there has been the possibility that the surface speed of the image bearing member and the surface speed of the intermediate transfer member would become uncontrollable in accordance with a load state at a nip portion for transferring an image on the image bearing member onto the intermediate transfer member. That is to say, there has been the possibility that the motor load will suddenly change at the time of transitioning from a state where developing agent is interposed at the nip portion to a state where developing agent is not interposed at the nip portion, and the rotation speed of the motor will become uncontrollable. Image defects such as described above occur in a state where the rotation speed of the motor has become uncontrollable.

In an image forming apparatus described in U.S. Patent Application Publication No. 2015/0362867, a target speed of the image bearing member is adjusted so that the load on the motor in a state where developing agent is supplied to the nip portion and the load on the motor in a state where developing agent is not supplied to the nip portion are reduced. This image forming apparatus acquires motor drive signals while supplying developing agent to the nip portion and switching motor speed instruction values, and acquires motor drive signals while not supplying developing agent to the nip portion and switching motor speed instruction values. Note that this image forming apparatus executes feedback control so that the rotation speed of the motor is a speed corresponding to the speed instruction value, so the motor drive signals change in accordance with the load of the motor. That is to say, this image forming apparatus predicts motor load from motor drive signals.

However, the image forming apparatus in U.S. Patent Application Publication No. 2015/0362867 switches the motor rotation speed to adjust the target speed of the image bearing member. Accordingly, images cannot be formed on sheets while the image forming apparatus is acquiring motor speed instruction values. That is to say, this image forming apparatus has had a problem in that great downtime occurs in order to decide the target speed for the image bearing member.

The image forming apparatus described in U.S. Patent Application Publication No. 2015/0362867 adjusts the target speed of the image bearing member at a timing where image forming operations are not being executed. However, in a case where the image forming apparatus forms a great number of images, friction between the image bearing member and intermediate transfer member changes. Accordingly, there has been a problem that the motor load changes when transitioning from a state where developing agent is interposed at the nip portion to a state where developing agent is not interposed at the nip portion. Accordingly, updating of the target speed of the image bearing member could not be performed at an appropriate timing in a case of continuously forming multiple images with the image forming apparatus described in U.S. Patent Application Publication No. 2015/0362867. That is to say, the target speed of the image bearing member could not be corrected to an appropriate target speed while the image forming apparatus is continuously forming multiple images.

SUMMARY OF THE INVENTION

An image forming apparatus that forms an image on a sheet includes an image forming unit, an intermediate transfer member, a transfer member, a transfer unit, a motor, a motor control unit, and a controller. The image forming unit includes a photosensitive member and a developer bearing member configured to bear a developing agent, and is configured to form the image on the photosensitive member using the developing agent. The image is transferred onto the intermediate transfer member. The transfer member is configured to form a nip portion for transferring the image formed on the photosensitive member onto the intermediate transfer member. The transfer unit is configured to transfer the image transferred onto the intermediate transfer member onto the sheet. The motor is configured to rotate the photosensitive member. The motor control unit is configured to control the motor so that the rotation speed of the photosensitive member is a target rotation speed. The controller is configured to acquire first load information of the photosensitive member in a first period where the motor control unit controls the motor to rotate the photosensitive member, the developer bearing member rotates, and the intermediate transfer member rotates, acquire second load information of the photosensitive member in a second period where the motor control unit controls the motor to rotate the photosensitive member, rotation of the developer bearing member is stopped, and the intermediate transfer member rotates, and control whether or not to change the target rotation speed based on the first load information and the second load information. The image forming unit consecutively forms a plurality of images while rotating the developer bearing member. In a case where the number of sheets on which the image is formed reaches a predetermined number while the plurality of images are consecutively being formed, the controller stops the image formation by the image forming unit and acquires the first load information, stops rotation of the developer bearing member and acquires the second load information, and controls whether or not to change the target rotation speed based on the first load information and the second load information.

Further features of the present invention will become apparent from the following description of exemplary embodiments with reference to the attached drawings.

DESCRIPTION OF THE EMBODIMENTS

First Embodiment

Image Forming Apparatus

Figure 1:
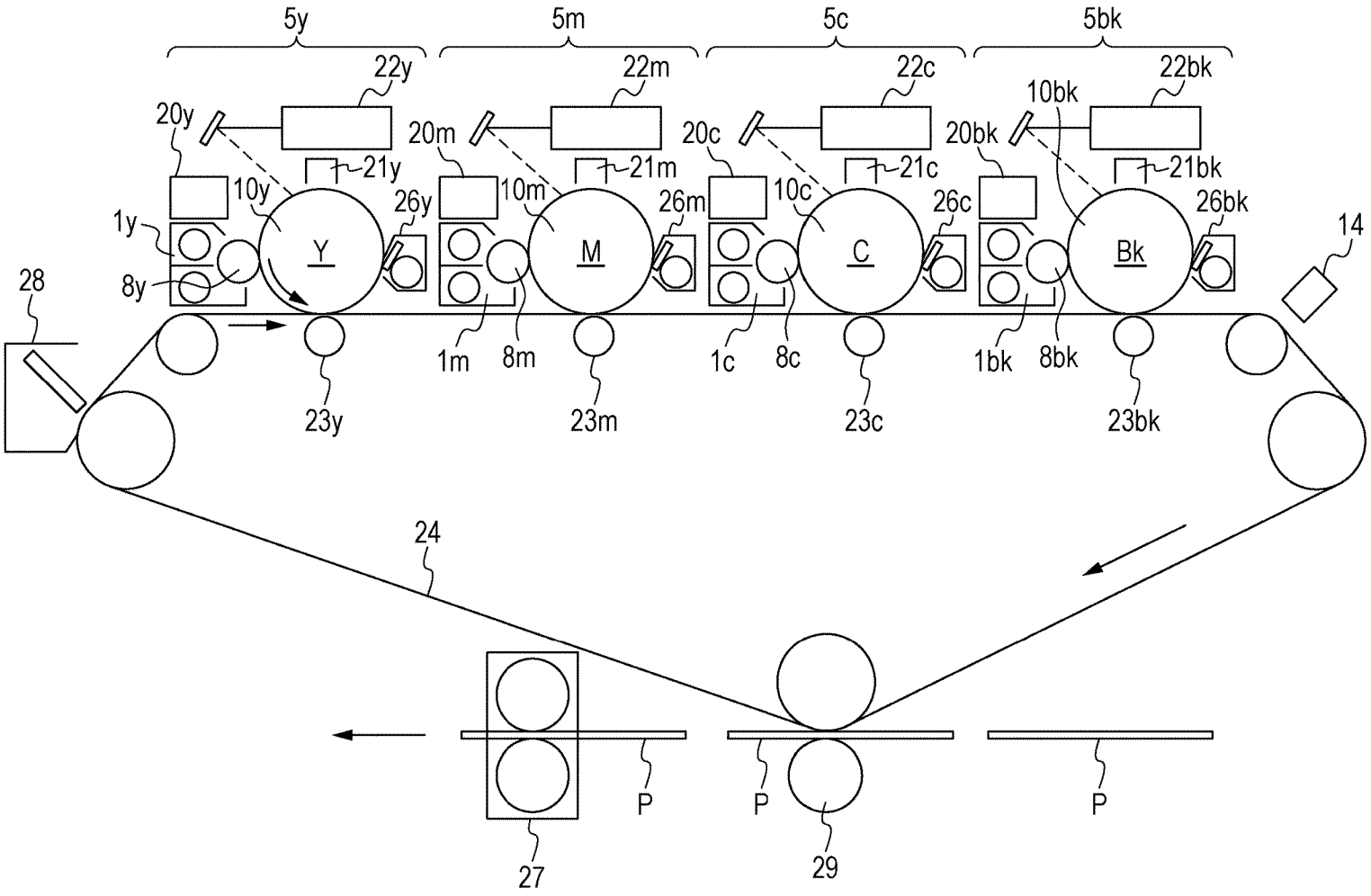
FIG. 1 is a schematic cross-sectional view of an image forming apparatus according to a first embodiment.

FIG. 1 illustrates principal portions of an image forming apparatus 100. The image forming apparatus 100 has four image forming units 5*y*, 5*c*, 5*m*, and 5*bk*, for forming images. The image forming units 5*y*, 5*c*, 5*m*, and 5*bk* each form images using developing agents of different colors. Developing agents for colors yellow (Y), magenta (M), cyan (C), and block (Bk), are used here. The y, m, c, and bk appended to the reference numerals indicate the color of the developing agent. The characters (y, m, c, bk) appended to the reference numerals will be omitted from the description in FIG. 1.

A photosensitive drum 10 (10*y*, 10*m*, 10*c*, 10*bk*) is an image bearing member that bears electrostatic latent images and images (developing agent images). A photosensitive layer is formed on the surface of the photosensitive drum 10. Accordingly, the photosensitive drum 10 serves as a photosensitive member. A charger 21 (21*y*, 21*m*, 21*c*, 21*bk*) uniformly charges the surface of the photosensitive drum 10. An exposing device 22 (22*y*, 22*m*, 22*c*, 22*bk*) exposes the charged photosensitive drum 10 and forms an electrostatic latent image. A laser beam from the exposing device 22 scans the surface of the photosensitive drum 10. The direction in which the laser beam scans the photosensitive drum 10 is referred to as the "main scanning direction". The exposing device 22 has optical members such as a rotary polygonal mirror rotationally driven to scan the laser beam, mirrors, lenses, and so forth. A developing unit 1 (1*y*, 1*c*, 1*m*, 1*bk*) develops the electrostatic latent image using developing agent, thereby forming an image. The developing agent is, for example, a two-component developing agent containing a non-magnetic developing agent and a magnetic carrier. Transfer bias Vtr1 is applied to a primary transfer roller 23 (23*y*, 23*m*, 23*c*, 23*bk*). Accordingly, the image borne by the photosensitive drum 10 is transferred by the primary transfer roller 23 onto an intermediate transfer belt 24. The intermediate transfer belt 24 functions as an intermediate transfer member onto which the image on the photosensitive drum 10 is transferred. Transfer bias Vtr2 is applied to a secondary transfer roller 29. Thus, the secondary transfer roller 29 transfers the image borne by the intermediate transfer belt 24 onto a sheet P.

A fixing unit 27 heats the image on the sheet P to fix the image onto the sheet P. A drum cleaner 26 (26*y*, 26*c*, 26*m*, 26*bk*) has a blade that comes into contact with the photosensitive drum 10. The drum cleaner 26 removes residual developing agent that was not transferred from the photosensitive drum 10 to the intermediate transfer belt 24. A blade of the drum cleaner 26 functions as a removal member that removes developing agent on the photosensitive drum 10. A belt cleaner 28 has a blade that comes into contact with the intermediate transfer belt 24, and removes residual developing agent that was not transferred from the intermediate transfer belt 24 to the sheet P. A developing agent supply bin 20 (20*y*, 20*c*, 20*m*, 20*bk*) supplies developing agent to the developing unit 1. A sensor 14 has a light emitting element and a light receiving element. The sensor 14 is an optical sensor that measures reflected light from a measuring image formed on the intermediate transfer belt 24. The measuring image is formed by the image forming units 5*y*, 5*m*, 5*c*, and 5*bk*.

Developing Unit

Figure 2:
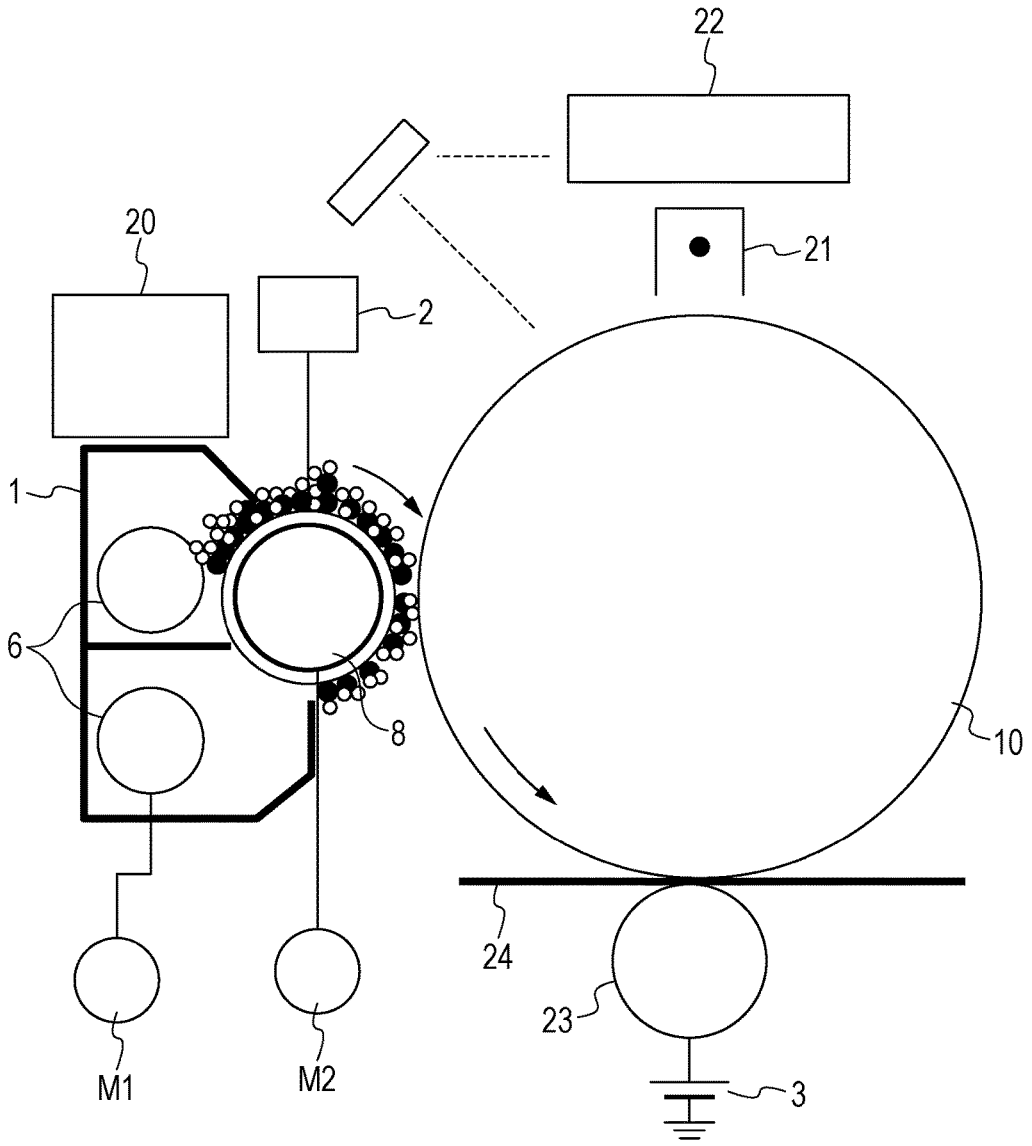
FIG. 2 is a schematic diagram of principal portions of an image forming unit.

FIG. 2 is a schematic diagram of principal portions of the image forming unit 5. The developing unit 1 has an agitation member 6 such as a screw or the like, that conveys the developing agent and carrier supplied from the developing agent supply bin 20 while agitating. The agitation member 6 is driven by a motor M1. Agitating the developing agent and the carrier causes the developing agent to be frictionally charged. A developing sleeve 8 (8*y*, 8*c*, 8*m*, 8*bk*) is a developer bearing member that bears developing agent. The developing sleeve 8 is disposed facing the photosensitive drum 10, and is driven by a motor M2. A power source unit 2 applies a superimposed voltage (developing bias), where AC voltage has been superimposed on DC voltage, to the developing sleeve 8, when developing an electrostatic latent image. The power source unit 2 functions as a voltage applying unit that applies the superimposed voltage so as to generate a potential difference between the photosensitive drum 10 and the developing sleeve 8. A power source unit 3 applies a predetermined DC voltage (transfer bias) to the primary transfer roller 23 in a case of transferring an image on the photosensitive drum 10 onto the intermediate transfer belt 24. The power source unit 3 applies DC voltage to the primary transfer roller 23, so that a potential difference is generated between he photosensitive drum 10 and the intermediate transfer belt 24.

Adjustment of Image Formation Position

Images formed by the image forming units 5*y*, 5*m*, 5*c*, and 5*bk* are transferred so as to be overlaid on the intermediate transfer belt 24. Accordingly, a full-color image is borne by the intermediate transfer belt 24. Accordingly, if the image formation positions (image formation timings) of the image forming units 5*y*, 5*m*, 5*c*, and 5*bk* are off, the color of the full-color image cannot be compensated. For example, there is a possibility that the image formation positions of the image forming units 5*y*, 5*m*, 5*c*, and 5*bk* may change due to temperature change of the image forming apparatus 100 or the number of images formed. Relative positional misalignment of images formed by the image forming units 5*y*, 5*m*, 5*c*, and 5*bk* is referred to as "color misregistration".

In order to correct color misregistration, the image forming apparatus 100 forms a measuring image (pattern image) for each color on the intermediate transfer belt 24, and detects the color registration amount by the sensor 14. The image forming apparatus 100 then corrects the write timing (exposure timing) for the image forming units 5*y*, 5*m*, 5*c*, and 5*bk* to form electrostatic latent images, based on the detected color registration amount. This processing is referred to as "color registration adjustment".

Figure 3:
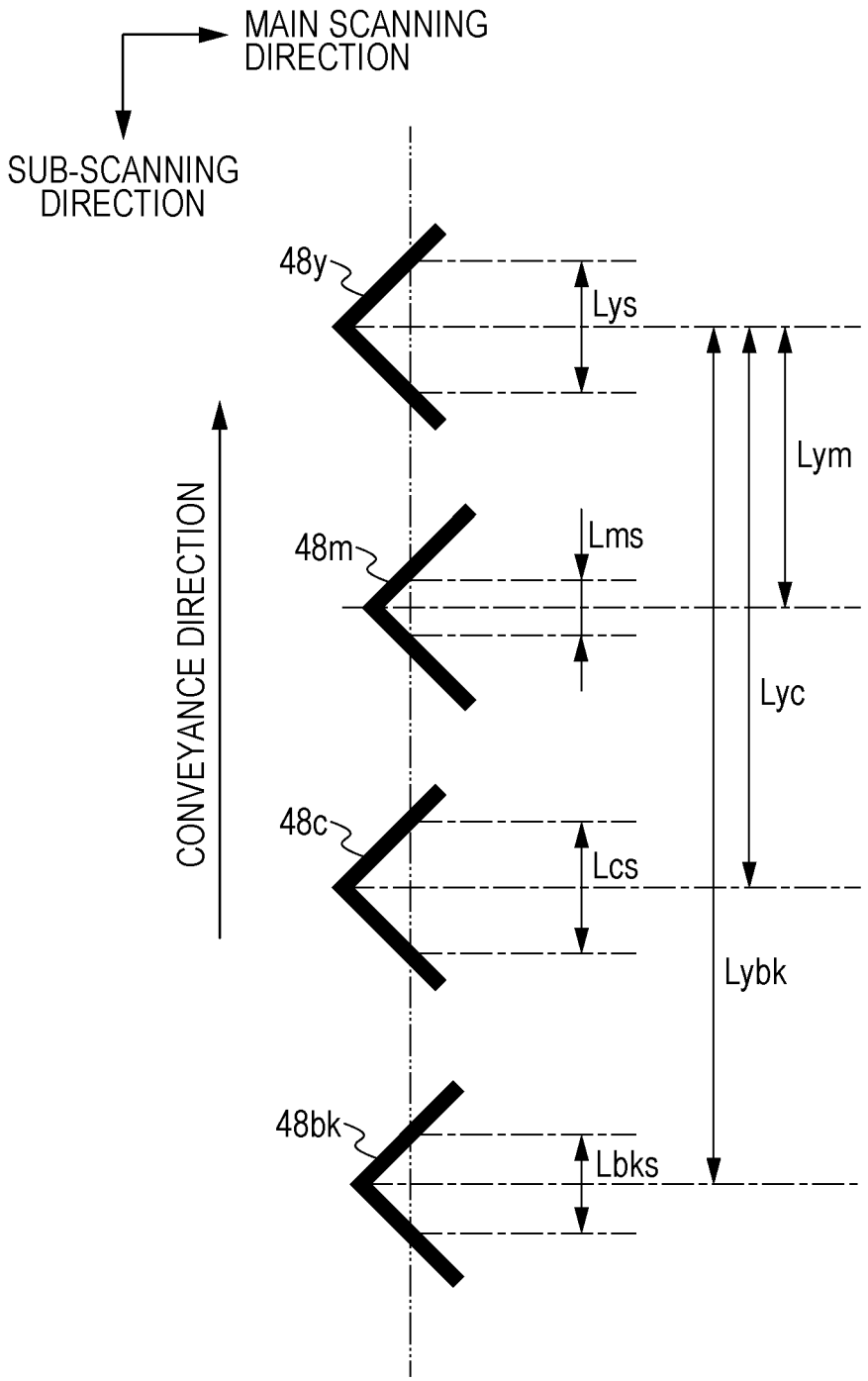
FIG. 3 is a schematic diagram of a pattern image.

FIG. 3 is a schematic diagram of pattern images formed on the intermediate transfer belt 24 in the color registration adjustment. Upon the color registration adjustment being started, the image forming apparatus 100 forms pattern images on the intermediate transfer belt 24, and the pattern images are measured by the sensor 14. Color registration adjustment is executed when execution conditions are satisfied. For example, execution conditions are satisfied in a case where an operator instructs execution of color registration adjustment. Also, execution conditions are satisfied in a case where the main power of the image forming apparatus 100 is turned on, for example. Another example of execution conditions being satisfied is when the number of images formed reaches a certain number.

Color patterns 48*y*, 48*m*, 48*c*, and 48*bk*, each of a different color, are included in the pattern images, as illustrated in FIG. 3. The color patterns 48*y*, 48*m*, 48*c*, and 48*bk* are V-shaped measurement images, for example. The intermediate transfer belt 24 moves in the conveyance direction. The two-dot dashed lines in FIG. 3 indicate the path of the measurement position by the sensor 14.

The image forming apparatus 100 acquires the time at which each of the color patterns 48*y*, 48*m*, 48*c*, and 48*bk* passed the sensor 14, based on the output values of the sensor 14. The image forming apparatus 100 measures transit time Lys at which the yellow color pattern 48*y*, for example, has passed the measurement position of the sensor 14, based on the measurement results by the sensor 14. The transit time Lys corresponds to the time of one edge of the yellow color pattern 48*y* passing the measurement position of the sensor 14 in the conveyance direction of the intermediate transfer belt 24, until the other edge of the yellow color pattern 48*y* reaches the measurement position of the sensor 14 in the conveyance direction. The image forming apparatus 100 similarly acquires transit time Lms of magenta color pattern 48*m*, transit time Lcs of cyan color pattern 48*c*, and transit time Lbks of black color pattern 48*bk*, based on measurement results of the sensor 14.

The transit times Lys, Lms, Lcs, and Lbks represent the image formation positions of the color patterns in the main scanning direction (direction orthogonal to the conveyance direction of the intermediate transfer belt 24). That is to say, the transit times Lys, Lms, Lcs, and Lbks represent the relative positional relationship between the color patterns in the main scanning direction. Accordingly, the color misregistration amount in the main scanning direction can be corrected by correcting the write timing of the images of each color in the main scanning direction, so that the transit times Lys, Lms, Lcs, and Lbks are the same value.

Next, a method for correcting the write timing for images of each color in the sub-scanning direction will be described. Transit time Lym corresponds to the time of the center position of the color pattern 48*y* passing the measurement position of the sensor 14 until the center position of the color pattern 48*m* reaches the measurement position of the sensor 14 in the conveyance direction. That is to say, the transit time Lym represents the relative positional relationship between the yellow color pattern 48*y* and the magenta color pattern 48*m* in the sub-scanning direction. The image forming apparatus 100 corrects the write timing of the magenta image in the sub-scanning direction so that the transit time Lym is a predetermined target transit time.

The transit time Lyc corresponds to the time of the center position of the color pattern 48*y* passing the measurement position of the sensor 14 until the center position of the color pattern 48*c* reaches the measurement position of the sensor 14. The transit time Lybk corresponds to the time of the center position of the color pattern 48*y* passing the measurement position of the sensor 14 until the center position of the color pattern 48*bk* reaches the measurement position of the sensor 14. The image forming apparatus 100 corrects the write timing of the cyan image in the sub-scanning direction so that the transit time Lyc is a predetermined target transit time in the sub-scanning direction, and corrects the write timing of the black image in the sub-scanning direction so that the transit time Lybk is a predetermined target transit time in the sub-scanning direction.

Thus, the correction amount of write timings in the main scanning direction and the correction amount of write timings in the sub-canning direction are decided based on the transit times of the color patterns 48*y*, 48*m*, 48*c*, and 48*bk*. Color misregistration is corrected by the decided correction amounts being reflected in the write timings by the exposing devices 22 handling each color.

Speed Control of Photosensitive Drum and Intermediate Transfer Belt

The photosensitive drum 10 and intermediate transfer belt 24 are rotationally driven while in contact. Accordingly, if the circumferential speed of the photosensitive drum 10 and the circumferential speed of the intermediate transfer belt 24 do not match, the length of the image may be incorrect, and banding may occur. Accordingly, the circumferential speed of the photosensitive drum 10 and the circumferential speed of the intermediate transfer belt 24 are adjusted to a level where incorrect image length and banding are not manifested. The image forming apparatus 100 has the target speed of the photosensitive drum 10 and the target speed of the intermediate transfer belt 24 set to different values, such that the circumferential speed of the photosensitive drum 10 is greater than the circumferential speed of the intermediate transfer belt 24, in order to increase transfer efficiency. The target value of the surface speed of the photosensitive drum 10 is around 0.15% faster than the target value of the surface speed of the intermediate transfer belt 24, for example.

Figure 4:
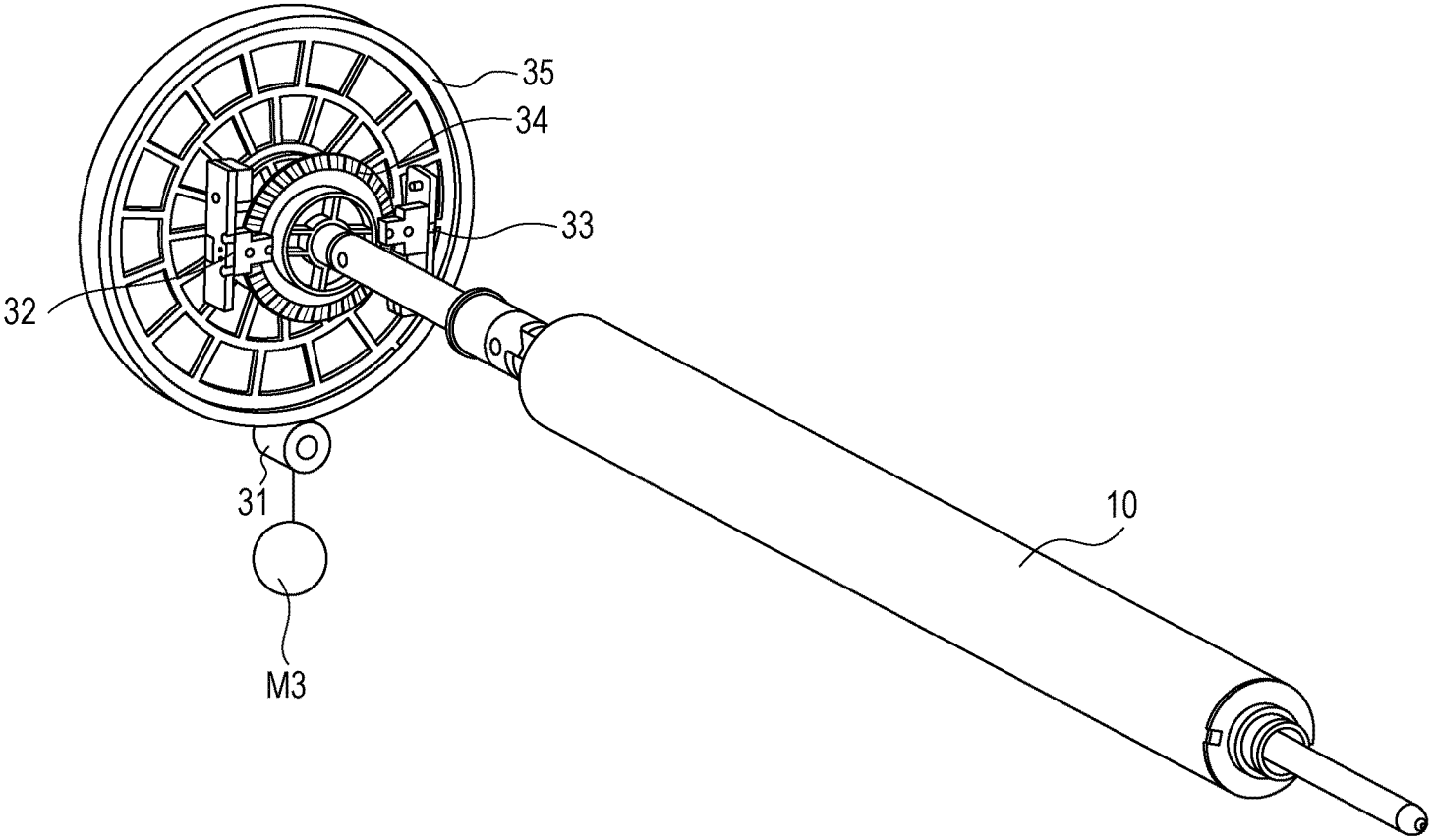
FIG. 4 is a schematic diagram of principal portions of a drive unit of a photosensitive drum.

FIG. 4 illustrates a drive unit that drives the photosensitive drum 10. Driving of the photosensitive drum 10 of the image forming unit 5*y* that forms yellow images will be described below. The configuration of the photosensitive drums 10 of the image forming units 5*m*, 5*c*, and 5*bk* are also the same as the photosensitive drum 10 of the image forming unit 5*y*. Accordingly, the image forming apparatus 100 has a motor 3M, motor gear 31, speed sensors 32 and 33, encoder 34, and drum drive gear 35, for each photosensitive drum 10.

The motor M3 drives the motor gear 31. The motor gear 31 meshes with the drum drive gear 35, and transmits the driving force transmitted from the motor M3 to the drum drive gear 35. The photosensitive drum 10 is fixed on a shaft of the drum drive gear 35, so the photosensitive drum 10 is rotated by the motor M3 driving the drum drive gear 35. The encoder 34 is fixed on the shaft of the drum drive gear 35. The encoder 34 is a rotating plate in which multiple slits are provided. The two speed sensors 32 and 33 are provided so as to detect these slits. The speed sensors 32 and 33 each have a light emitting element and a light receiving element, and count the number of rotations where light emitted from the light emitting element passes through the slits and reaches the light receiving element. The number of counts per unit of time is equivalent to the rotation speed of the photosensitive drum 10. The outputs of the two speed sensors 32 and 33 are averaged. This is to reduce the effect of eccentricity of the encoder 34.

The image forming apparatus 100 has a motor driver 1300 (FIG. 7) for each photosensitive drum 10. Each motor driver 1300 performs feedback control of a value of the current (pulse width modulation (PWM) signal) flowing through the motor M3, so that the rotation speed of the drum drive gear 35 detected by the speed sensors 32 and 33 is the target speed. The PWM signal value supplied to the motor M3 is equivalent to electric power supplied to the motor M3 per predetermined amount of time. Further, in a state where the rotation speed of the photosensitive drum 10 is controlled to the target speed, the PWM signal value input to the motor M3 changes in accordance with the load on the photosensitive drum 10. That is to say, the PWM signal value input to the motor M3 is information relating to torque (load information) of the motor M3.

Figure 5:
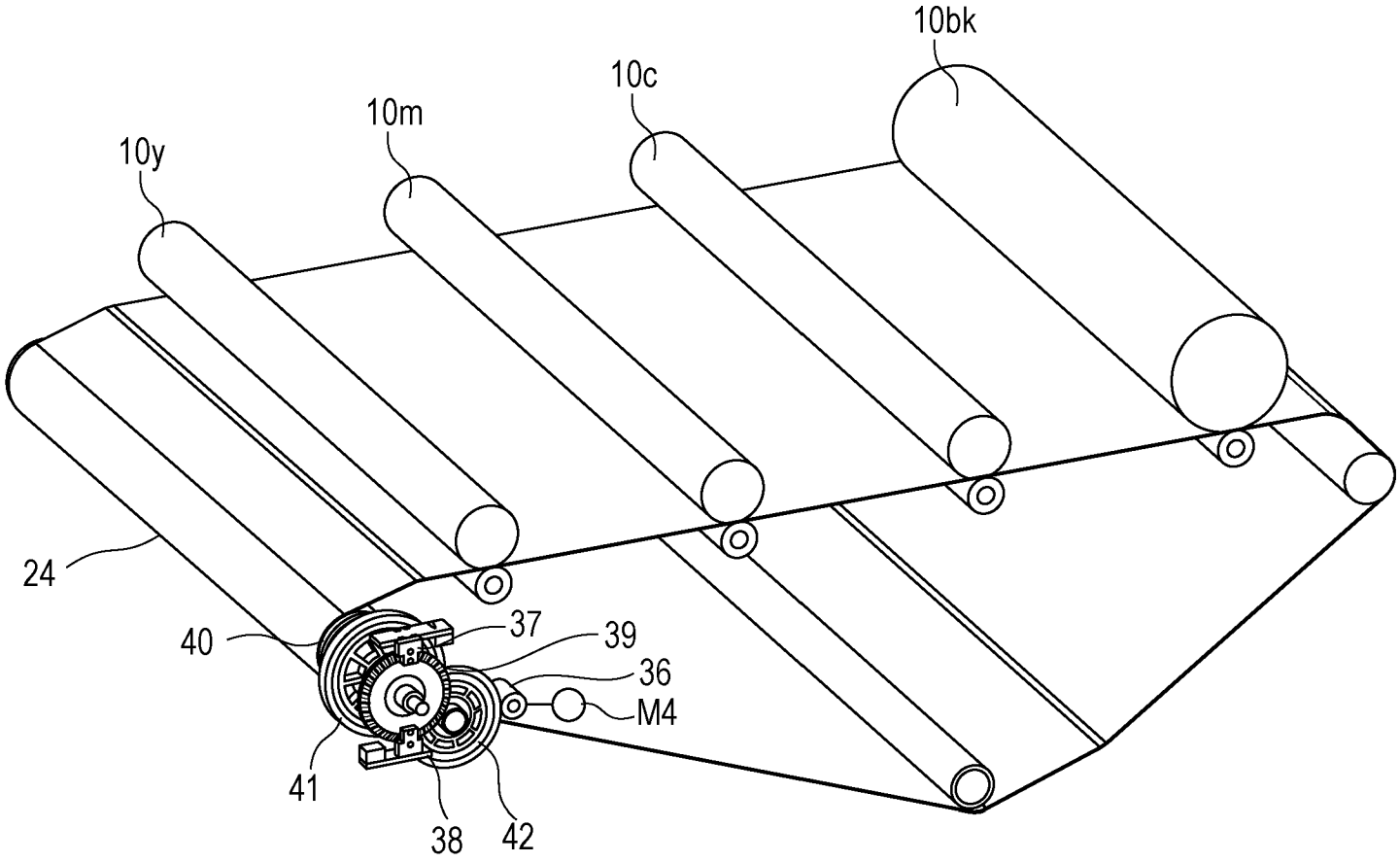
FIG. 5 is a schematic diagram of principal portions of a drive unit of an intermediate transfer belt.

FIG. 5 illustrates a drive unit that drives the intermediate transfer belt 24. A motor M4 drives a motor gear 36. The motor gear 36 meshes with a drive gear 42, and transmits driving force transmitted from the motor M4 to the drive gear 42. The drive gear 42 further meshes with a drive gear 41. A drive roller 40 is provided on a shaft of the drive gear 41. The drive roller 40 is rotated by the motor M4 driving the drive gears 41 and 42, and the intermediate transfer belt 24 is rotated by the drive roller 40. An encoder 39 is further provided on the shaft of the drive gear 41. The encoder 39 is a rotating plate in which multiple slits are provided. Two speed sensors 37 and 38 are provided so as to detect these slits. The speed sensors 37 and 38 each have a light emitting element and a light receiving element, and count the number of rotations where light emitted from the light emitting element passes through the slits and reaches the light receiving element. The number of counts per unit of time is equivalent to the rotation speed. The outputs of the two speed sensors 37 and 38 are averaged. This is to reduce the effect of eccentricity of the encoder 39.

The image forming apparatus 100 performs feedback control of the current (PWM signals) flowing at the motor M4, so that the rotation speed of the drive gear 41 detected by the speed sensors 37 and 38 is the target speed. That is to say, the PWM signal value supplied to the motor M4 is controlled so that the moving speed of the intermediate transfer belt 24 is the target speed. The PWM signal value supplied to the motor M4 is equivalent to the value of the current flowing at the motor M4. Further, in a state where the rotation speed of the drive roller 40 is controlled to the target speed, the PWM signal value input to the motor M4 changes in accordance with the load on the drive roller 40. That is to say, the PWM signal value input to the motor M4 is information relating to torque, or load, of the intermediate transfer belt 24.

Next, the adverse effects of friction between the photosensitive drum 10 and intermediate transfer belt 24 increasing will be described in detail. Note that the target speed of the surface speed of the photosensitive drum 10 is, for example, 0.15% faster than the target speed of the surface speed of the intermediate transfer belt 24. That is to say, the circumferential speed difference between the intermediate transfer belt 24 and the photosensitive drum 10 is 0.15%.

There are generally two states regarding the friction acting between the photosensitive drum 10 and the intermediate transfer belt 24. One is a state where the photosensitive drum 10 rotates, the intermediate transfer belt 24 rotates, and the developing sleeve 8 rotates. The image forming apparatus 100 is in the first state when forming images. In the first state, developing agent is supplied to the nip portion of the photosensitive drum 10 and intermediate transfer belt 24 (developing nip portion). That is to say, developing agent is interposed at the plane of transfer between the photosensitive drum 10 and intermediate transfer belt 24. The second state is a state where the photosensitive drum 10 rotates and the intermediate transfer belt 24 rotates, but the developing sleeve 8 is stopped. In the second state, developing agent is not interposed at the nip portion of the photosensitive drum 10 and intermediate transfer belt 24. That is to say, no developing agent is interposed at the plane of transfer between the photosensitive drum 10 and intermediate transfer belt 24. This second state is a state after developing one page worth of images, or before image formation starts, for example.

When the developing sleeve 8 rotates, developing agent is supplied to the photosensitive drum 10, thereby consuming developing agent within the developing unit 1. Accordingly, the image forming apparatus 100 only rotates the developing sleeve for a minimally necessary amount of time for image formation. That is to say, the image forming apparatus 100 starts rotation of the developing sleeve 8 at a timing immediately before image formation, and stops rotation of the developing sleeve 8 promptly after ending image formation.

In a case of forming images based on image data, the image forming apparatus 100 transitions from a state where there is no developing agent interposed at the nip portion to state where developing agent is interposed at the nip portion. After forming images based on image data, the image forming apparatus 100 then transitions from state where developing agent is interposed at the nip portion so state where there is no developing agent interposed at the nip portion.

In a case where the friction force between the photosensitive drum 10 and intermediate transfer belt 24 greatly differs between the first state and the second state, a great load change will be placed upon the photosensitive drum 10 and intermediate transfer belt 24 when the state at the nip portion changes in the image forming apparatus 100. The state at the nip portion changes when starting image formation, so a load change occurs at the photosensitive drum 10 and intermediate transfer belt 24 every time the image forming apparatus 100 starts image formation. In a case where the amount of change in load exceeds a permissible range, the rotation speed of the motor M3 rotating the photosensitive drum 10 and the motor M4 rotating the drive roller 40 will become unstable. Forming images in a state where the rotation speed of the motor M3 or the rotation speed of the motor M4 is unstable will result in change in image density and occurrence of color misregistration.

Accordingly, the image forming apparatus 100 executes control to reduce the difference in the surface speed of the photosensitive drum 10 and the surface speed of the intermediate transfer belt 24, in accordance with the frictional force between the photosensitive drum 10 and intermediate transfer belt 24. Accordingly, the image forming apparatus 100 can reduce the difference in speed before image defects occur, and reduce frictional force.

Figure 6:
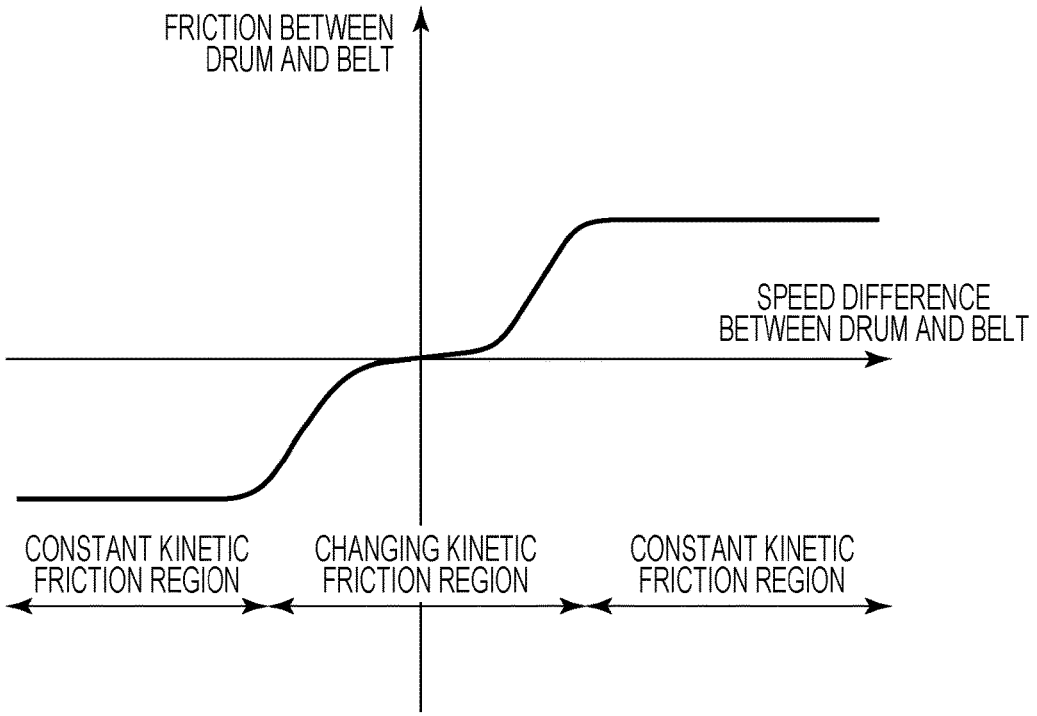
FIG. 6 is an explanatory diagram of friction force characteristics.

Description will be made regarding the phenomenon where frictional force increases when the speed difference increases. Generally, there are two types of frictional force between objects; static frictional force and kinetic frictional force. Kinetic frictional force does not change in accordance with the relative speed between objects, and is a constant value. Accordingly, even if the difference in speed between the photosensitive drum 10 and intermediate transfer belt 24 changes, the kinetic frictional force is constant. However, it is generally known that kinetic frictional force becomes constant when the speed difference between objects is rather great. The speed difference between the photosensitive drum 10 and the intermediate transfer belt 24 in the image forming apparatus 100 is normally around 1% or so. Accordingly, the physical law that kinetic frictional force is constant does not apply here. It is also known that in systems where speed difference is minute, such as in this case, the greater the speed difference is, the greater the frictional force becomes, as illustrated in FIG. 6.

Adjustment Processing of Target Speed

The image forming apparatus 100 acquires the PWM signal value of the motor M3 in a state where developing agent is interposed at the nip portion, and the PWM signal value of the motor M3 in a state where no developing agent is interposed at the nip portion. The image forming apparatus 100 controls whether or not to change the target speed of the photosensitive drum 10, based on the PWM signal values acquired in the two states. Adjustment processing for adjusting the target speed of the photosensitive drum 10 will be described below. The image forming apparatus 100 can set the target speed of each of the photosensitive drums 10 of the image forming units 5*y*, 5*m*, 5*c*, and 5*bk*.

Figure 7:
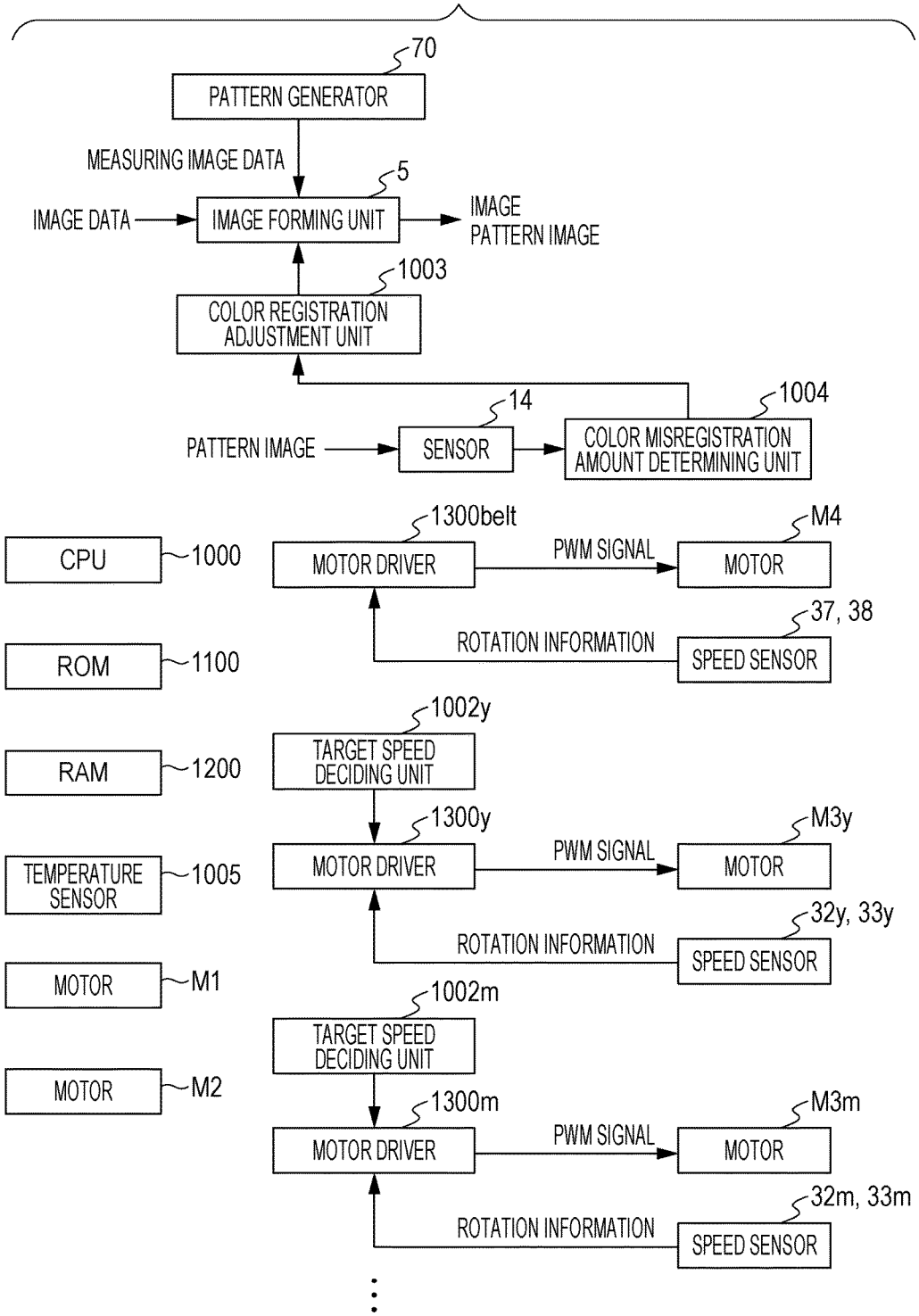
FIG. 7 is a control block diagram of an image forming apparatus.

FIG. 7 is a control block diagram of the image forming apparatus 100. A central processing unit (CPU) 1000 is a control circuit controlling each of the parts of the image forming apparatus 100. Read-only memory (ROM) 1100 stores control programs necessary for executing various types of processing in the like executed by the CPU 1000, described later by way of flowcharts. Random access memory (RAM) 1200 is system work memory used by the CPU 1000 when operating. A temperature sensor 1005 measures internal temperature within the image forming apparatus 100. The image forming units 5*y*, 5*c*, 5*m*, and 5*bk* (image forming unit 5 in FIG. 7), sensor 14, motors M1, M2, and M4, and speed sensors 37 and 38 have already been described, so description will be omitted here.

Motor M3*y* is the motor that rotates the photosensitive drum 10 forming yellow images (hereinafter referred to as photosensitive drum 10*y*) at the image forming unit 5*y*. Motor M3*m* is the motor that rotates the photosensitive drum 10 forming magenta images (hereinafter referred to as photosensitive drum 10*m*) at the image forming unit 5*m*. The image forming apparatus 100 further has a motor (omitted from illustration) that rotates the photosensitive drum 10 forming cyan images at the image forming unit 5*c*, and motor (omitted from illustration) that rotates the photosensitive drum 10 forming black images at the image forming unit 5*bk*.

Speed sensors 32*y* and 33*y* are optical sensors attached to the drive gear of the photosensitive drum 10*y*. The speed sensors 32*y* and 33*y* output detection results corresponding to rotation information of the photosensitive drum 10*y*. Further, speed sensors 32*m* and 33*m* are optical sensors attached to the drive gear of the photosensitive drum 10*m*. The speed sensors 32*m* and 33*m* output detection results corresponding to rotation information of the photosensitive drum 10*m*. The image forming apparatus 100 further has speed sensors that detection results corresponding to output rotation information of the photosensitive drum 10 that forms cyan images at the image forming unit 5*c*, and speed sensors that detection results corresponding to output rotation information of the photosensitive drum 10 that forms black images at the image forming unit 5*bk*.

A pattern generator 70 outputs measuring image data in a case where color registration adjustment is executed. The image forming units 5 form pattern images (FIG. 3) on the intermediate transfer belt 24, based on measuring image data transferred from the pattern generator 70. The CPU 1000 causes the pattern images on the intermediate transfer belt 24 to be conveyed, and the sensor 14 to measure the pattern images. The sensor 14 outputs measurement results of the pattern images to a color misregistration amount determining unit 1004.

The color misregistration amount determining unit 1004 computes transit time Lys, Lms, Lcs, and Lbks, and transit time Lym, Lyc, and Lybk, based on the measurement results of the pattern images by the sensor 14. The color misregistration amount determining unit 1004 then determines the color misregistration amount in the main scanning direction from the transit time Lys, Lms, Lcs, and Lbks, and determines the color misregistration amount in the sub-scanning direction from the transit time Lym, Lyc, and Lybk. Color registration amount, containing the color misregistration amount in the main scanning direction and the color misregistration amount in the sub-scanning direction, is output to a color registration adjustment unit 1003.

The color registration adjustment unit 1003 corrects the write timing for the images of each color, based on the color registration amount. The method by which the color registration adjustment unit 1003 corrects the write timing based on the color registration amount is known technology, so description will be omitted here.

A motor driver 1300 belt controls PWM signal values input to the motor M4, so that the rotation speed of the drive roller 40 detected by the speed sensors 37 and 38 are at a target rotation speed. Accordingly, the current flowing at the motor M4 is controlled such that the rotation speed of the drive roller 40 for driving the intermediate transfer belt 24 is the target rotation speed.

Upon the target rotation speed of the photosensitive drum 10*y* having been set, the motor driver 1300*y* controls the PWM signal value input to the motor M3*y*, so that the rotation speed of the photosensitive drum 10*y* detected by the speed sensors 32*y* and 33*y* is the target rotation speed. Accordingly, current flowing at the motor M3*y* is controlled so that the rotation speed of the photosensitive drum 10*y* is the target rotation speed. The PWM signal value for controlling the motor M3*y*, output from the motor driver 1300*y*, is stored in the RAM 1200. This is for a later-described target speed deciding unit 1002*y* to decide the target rotation speed of the photosensitive drum 10*y* based on the PWM signal value of the motor M3*y* stored in the RAM 1200. The motor driver 1300*y* controls driving of the motor M3*y*.

Upon the target rotation speed of the photosensitive drum 10*m* having been set, the motor driver 1300*m* controls the PWM signal value input to the motor M3*m*, so that the rotation speed of the photosensitive drum 10*m* detected by the speed sensors 32*m* and 33*m* is the target rotation speed. Accordingly, current flowing at the motor M3*m* is controlled so that the rotation speed of the photosensitive drum 10*m* is the target rotation speed. The PWM signal value for controlling the motor M3*m*, output from the motor driver 1300*m*, is stored in the RAM 1200. This is for a later-described target speed deciding unit 1002*m* to decide the target rotation speed of the photosensitive drum 10*m* based on the PWM signal value of the motor M3*m* stored in the RAM 1200. The motor driver 1300*m* functions as a drive control unit that controls driving of the motor M3*m*.

The image forming apparatus 100 further has a motor driver (omitted from illustration) that controls driving of a motor (omitted from illustration) that rotates the photosensitive drum 10 by which cyan images are formed at the image forming unit 5*c*, and a target speed deciding unit that decides a target rotation speed of the motor. In the same way, the image forming apparatus 100 also has a motor driver (omitted from illustration) that controls driving of a motor (omitted from illustration) that rotates the photosensitive drum 10 by which black images are formed at the image forming unit 5*bk*, and a target speed deciding unit that decides a target rotation speed of the motor.

The target speed deciding unit 1002*y* may be realized by an application specific integrated circuit (ASIC), for example. The target speed deciding unit 1002*y* decides a target speed where the surface speed of the photosensitive drum 10 is faster than the surface speed of the intermediate transfer belt 24, unless the frictional force between the photosensitive drum 10 and the intermediate transfer belt 24 is not at a value to cause image defects. On the other hand, in a case where the frictional force between the photosensitive drum 10 and the intermediate transfer belt 24 has increased to a level that will cause image defects, the target speed deciding unit 1002*y* changes the target speed of the photosensitive drum 10*y* in the target speed adjustment processing. That is to say, the target rotation speed of the photosensitive drum 10*y* is set so that the difference between the target value of the surface speed for the photosensitive drum 10*y* and the target value of the surface speed for the intermediate transfer belt 24 is reduced. The target speed deciding unit 1002*y* reads out the PWM signal value in the first state and the PWM signal value in the second state that are stored in the RAM 1200, and decides a target value for the photosensitive drum 10*y* based on the PWM signal value in the first state and the PWM signal value in the second state. The target speed deciding unit 1002*y* may have a configuration where part of the functions of the CPU 1000 decides the target speed based on a PWM signal.

Image forming operations where the image forming apparatus 100 forms images based on image data will be described based on the flowchart in FIG. 8. Upon image data being input from a personal computer (PC), omitted from illustration, the CPU 1000 reads out a program stored in ROM 1100, and executes the processing of the flowchart in FIG. 8. Note that in the following description, the suffixes y, m, c, and bk will be omitted, and the components will be written as photosensitive drum 10, developing sleeve 8, target speed deciding unit 1002, motor driver 1300, motor M3, and speed sensors 32 and 33.

First, the CPU 1000 rotates the photosensitive drum 10, intermediate transfer belt 24, and developing sleeve 8 (S800). The motor driver 1300 controls PWM signals input to the motor M3. The motor driver 1300 executes feedback control based on the detection results of the speed sensors 32 and 33, so that the rotation speed of the photosensitive drum 10 is the target speed. Note that each time an image is formed, the motor driver 1300 updates the PWM signal value. The motor M3 rotates the photosensitive drum 10 based on the PWM signal value input from the motor driver 1300. The motor driver 1300 belt executes feedback control based on the detection results of the speed sensors 37 and 38, so that the surface speed of the intermediate transfer belt 24 is the target speed. The motor driver 1300 belt updates the PWM signal value each time an image is formed. The motor M4 rotates the drive roller 40 of the intermediate transfer belt 24 based on the PWM signal value input from the motor driver 1300 belt. Note that the PWM signal value output from the motor driver 1300 (1300*y*, 1300*m*, 1300*c*, 1300*bk*) is not only supplied to the motor M3 (M3*y*, M3*m*, M3*c*, M3*bk*), but also is stored in the RAM 1200.

The motors M1 and M2 rotate the developing sleeve 8 and agitation member 6 of the developing unit 1 in step S800. Feedback control is executed so that the motor M1 that rotates the agitation member 6 rotates at a predetermined speed. Further, feedback control is executed so that the motor M2 that rotates the developing sleeve 8 rotates at a standard speed.

Upon the developing sleeve 8 rotating in step S800, a small amount of developing agent is supplied from the developing sleeve 8 to the photosensitive drum 10, regardless of the developing bias supplied from the power source unit 2. This small amount of developing agent is supplied to the nip portion of the photosensitive drum 10 and the intermediate transfer belt 24 in accordance with rotation of the photosensitive drum 10. The state at the photosensitive drum 10 and intermediate transfer belt 24 in step S800 thus transitions from a state where no developing agent is interposed at the nip portion to a state where developing agent is interposed at the nip portion. When developing agent is supplied to the nip portion of the photosensitive drum 10 and intermediate transfer belt 24, the frictional force between the photosensitive drum 10 and the intermediate transfer belt 24 decreases.

The CPU 1000 controls the image forming unit 5 (5*y*, 5*m*, 5*c*, 5*bk*) to form an image (S801). The image forming units 5 form a full-color image by sequentially overlaying images of the color components upon the intermediate transfer belt 24. After a first amount of time has elapsed after the image data has been transferred, the CPU 1000 stores the PWM signal value output from the motor driver 1300 (PWMduty1) in the RAM 1200 (S802). When the developing sleeve 8 starts to rotate, developing agent is supplied from the developing sleeve 8 to the photosensitive drum 10. The developing agent supplied to the photosensitive drum 10 is conveyed to the nip portion. The CPU 1000 stores the PWM signal value (PWMduty1) in the RAM 1200, after the first amount of time has elapsed from the time point at which the developing sleeve 8 started to rotate, in order to acquire the PWM signal value (PWMduty1) in the state where developing agent is interposed at the nip portion. Note that the first amount of time is decided by the distance from a developing position where the photosensitive drum 10 and developing sleeve 8 face each other to the nip portion of the photosensitive drum 10 and intermediate transfer belt 24, and the rotation speed of the photosensitive drum 10. The first amount of time is stored in the ROM 1100 beforehand.

The photosensitive drum 10, intermediate transfer belt 24, and developing sleeve 8 rotate as long as image formation is being executed. Accordingly, the state is the first state where toner is interposed at the nip portion, as long as image formation processing is being executed. The CPU 1000 stores the PWM signal value (PWMduty1) in the RAM 1200. The PWM signal value (PWMduty1) in the first state corresponds to a first signal value (first information) that changes in accordance with the torque of the motor M3.

Next, the CPU 1000 determines whether or not an image has been formed of the image data (S803). If formation of the image is not completed in step S803, the CPU 1000 transitions the processing to step S802. That is to say, the CPU 1000 continues updating PWMduty1 until image formation ends.

After formation of the image is completed in step S803, the CPU 1000 stops image formation at the image forming unit 5 (S804). In step S804, the CPU 1000 stops charging processing of the photosensitive drum 10 by the charger 21, and stops irradiation by laser beam by the exposing device 22.

Next, the CPU 1000 stops the rotation of the developing sleeve 8 (S805). In step S805, the CPU 1000 controls the motor driver 1300 to stop rotation of the motor M2. The photosensitive drum 10 and the drive roller 40 of the intermediate transfer belt 24 are continuing rotation at this time.

After a second amount of time has elapsed after rotation of the developing sleeve 8 has stopped in step S805, the CPU 1000 stores the PWM signal value (PWMduty2) output from the motor driver 1300 in the RAM 1200 (S806). When the rotation of the developing sleeve 8 stops, supply of developing agent from the developing sleeve 8 to the photosensitive drum 10 stops. However, there is a time lag from the developing sleeve 8 to stop rotating until the developing agent on the photosensitive drum 10 passes through the nip portion. The CPU 1000 stores the PWM signal value (PWMduty2) in the RAM 1200 after the second amount of time has passed from the time point that the developing sleeve 8 stops rotating, in order to acquire the PWM signal value (PWMduty2) in a state where there is no developing agent interposed at the nip portion. Note that the second amount of time is decided by the distance from a developing position where the photosensitive drum 10 and developing sleeve 8 face each other to the nip portion of the photosensitive drum 10 and intermediate transfer belt 24, and the rotation speed of the photosensitive drum 10. The second amount of time is stored in the ROM 1100 beforehand.

After the developing sleeve 8 stops rotating, the state at the nip portion is the second state where no toner is interposed. The CPU 1000 stores the PWM signal value (PWMduty2) is the RAM 1200 in this state. The PWM signal value (PWMduty2) in the second state corresponds to a second signal value (second information) that changes in accordance with the torque of the motor M3.

The CPU 1000 then stops rotation of the photosensitive drum 10, and stops driving of the intermediate transfer belt 24 (S807). The motor driver 1300 stops supplying PWM signals to the motor M3, and the motor driver 1300 belt stops supplying PWM signals to the motor M4. The CPU 1000 then ends the image formation operations. Next, the CPU 1000 executes adjustment processing to adjust the target speed of the photosensitive drum 10.

Adjustment processing will be described with reference to the flowchart in FIG. 9. After having executed the image formation operations based on the image data, the CPU 1000 reads out a program stored in the ROM 1100, and executes the processing of the flowchart in FIG. 9.

First, the CPU 1000 determines whether or not a difference ΔPWMduty between PWM signal values is greater than a first threshold value Tha (S900). The target speed deciding unit 1002 reads out the PWM signal values stored in the RAM 1200. The RAM 1200 stores the PWM signal value (PWMduty1) of the state where developing agent is interposed at the nip portion, and the PWM signal value (PWMduty2) of the state where developing agent is not interposed at the nip portion. The target speed deciding unit 1002 computes the difference ΔPWMduty based on Expression (1) in step S900.

$$\Delta PWMduty = PWMduty2 - PWMduty1 \quad \text{Expression (1)}$$

In a case where the difference ΔPWMduty of PWM signal values is greater than the first threshold value Tha, this means that the difference in frictional force between the state where developing agent is interposed at the nip portion and the state where developing agent is not interposed at the nip portion has increased to a level that will cause image defects. In a case where the difference ΔPWMduty of PWM signal values is greater than the first threshold value Tha in step S900, the target speed deciding unit 1002 changes the target speed of the photosensitive drum 10 (S901). In step S901, the target speed deciding unit 1002 decides the target speed of the photosensitive drum 10 based on Expression (2).

$$\text{Target speed } Vt(n+1) = \text{current target speed } Vt(n) - \text{coefficient} \times \Delta PWMduty \quad \text{Expression (2)}$$

The CPU 1000 then executes color registration adjustment (S902), and ends adjustment processing. Note that the coefficient has a positive value.

When the target speed of the photosensitive drum 10 is changed, the length of the image in the rotational direction of the photosensitive drum 10, formed on the photosensitive drum 10, changes. For example, there is a possibility that the write position in the sub-scanning direction may be different for each color. Accordingly, in a case where the target speed of the photosensitive drum 10 is changed, the CPU 1000 executes color registration adjustment in step S902.

Also, in a case where the difference ΔPWMduty of PWM signal values is not greater than the first threshold value Tha in step S900, the CPU 1000 determines whether or not color registration adjustment execution conditions are satisfied (S903). In a case where an accumulated value of the number of sheets on which the image forming apparatus 100 has formed images (number of formed images) has reached a predetermined number after the previous color registration adjustment was performed in step S903, the CPU 1000 determines that execution conditions are satisfied. In a case where color registration adjustment execution conditions are satisfied in step S903, the target speed deciding unit 1002 determines whether or not the ΔPWMduty of PWM signal values is greater than a second threshold value Thb (S904). Note that this second threshold value Thb is a smaller value than the first threshold value Tha. In a case where the difference ΔPWMduty of PWM signal values is greater than the second threshold value Thb in S904, the CPU 1000 transitions to the processing in step S901 to change the target speed of the photosensitive drum 10.

On the other hand, in a case where the difference ΔPWMduty of PWM signal values is not greater than the second threshold value Thb in step S904, the CPU 1000 transitions the processing to step S902, executes color registration adjustment, and ends target speed adjustment processing. The target speed of the photosensitive drum 10 is not changed at this time.

In a case where execution conditions of color registration adjustment are not satisfied in step S903, the CPU 1000 ends the target speed adjustment processing without executing color registration adjustment. The target speed of the photosensitive drum 10 is not changed in this case.

The adjustment processing is executed for each motor that devices a photosensitive drum. Accordingly, in a case where the target speed is charged for even one photosensitive drum 10 out of the photosensitive drums 10 for yellow, magenta, cyan, and black, the CPU 1000 executes color registration adjustment.

The target speed of the photosensitive drum 10 is changed before the frictional force increases, by the processing described with reference to the flowcharts in FIGS. 8 and 9. Accordingly, the image forming apparatus 100 can reduce the frictional force between the photosensitive drum 10 and intermediate transfer belt 24. Further, in a case where conditions for executing color registration adjustment are satisfied, the target speed is changed before the frictional force fully increases. Accordingly, the frequency of color registration adjustment executed in conjunction with the target speed having been changed can be suppressed as compared to a configuration where only one threshold value is used.

Figure 10A:
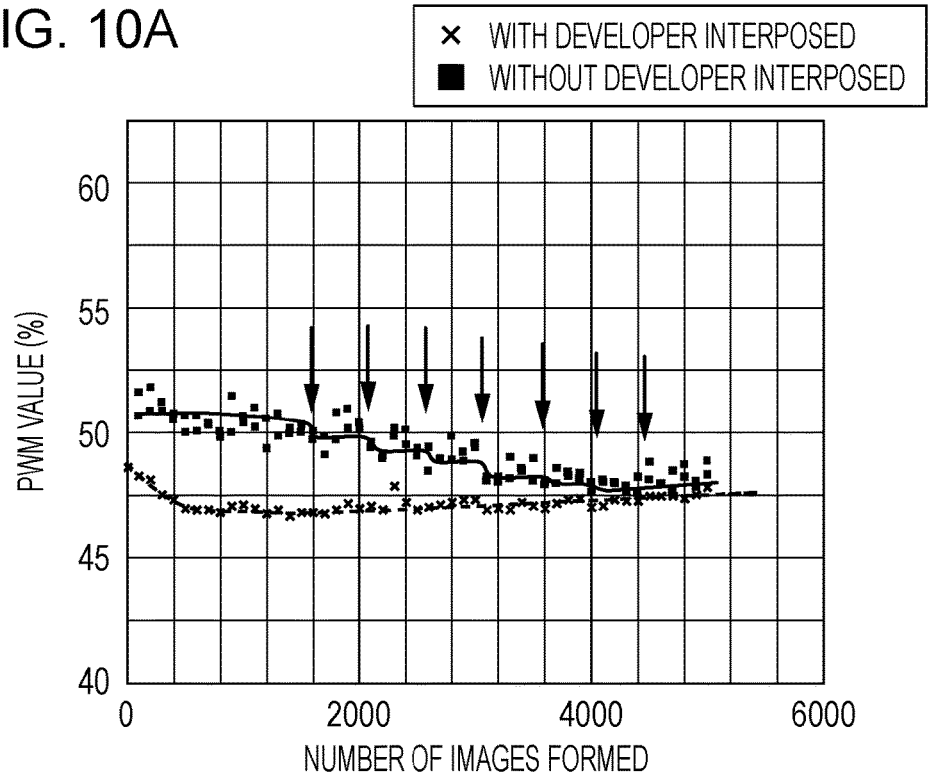
FIGS. 10A and 10B are diagrams illustrating measurement results regarding number of images formed and motor pulse width modulation (PWM) signal values.
Figure 10B:
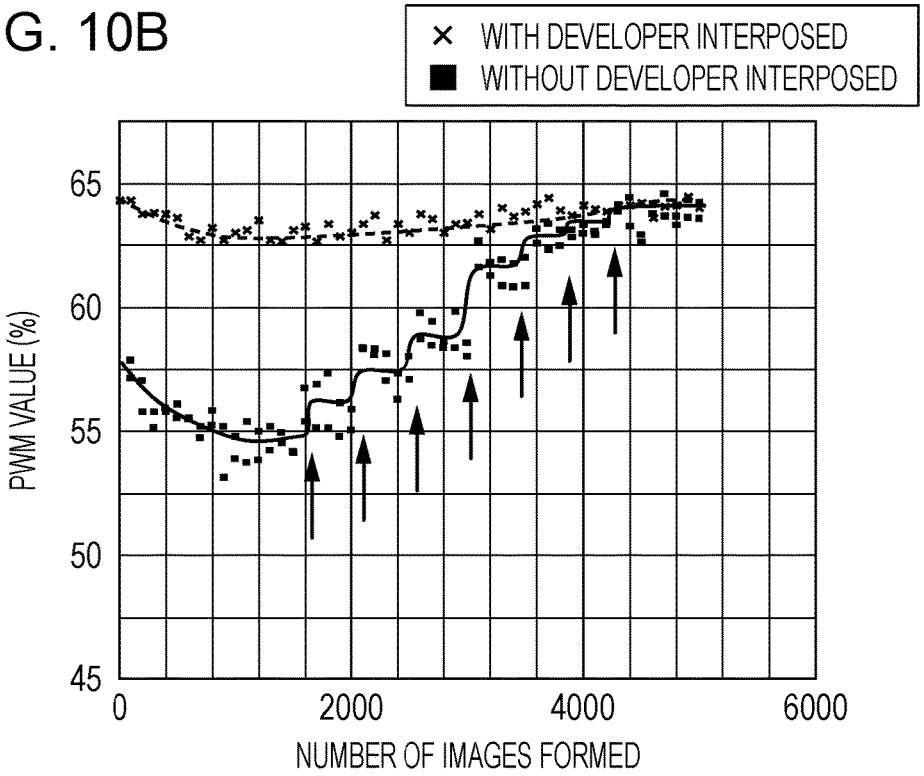

FIG. 10A illustrates PWM signal values of the yellow photosensitive drum 10*y*, obtained by experimentation, plotted on a graph. The arrows indicate the timing at which the target speed of the photosensitive drum 10*y* was changed. The difference between PWM signal values when developing agent is interposed at the nip portion and PWM signal values when developing agent is not interposed at the nip portion decreases each time the target speed is changed. FIG. 10B illustrates PWM signal values of the intermediate transfer belt 24, plotted on a graph. It can be seen that changing the target speed of the photosensitive drum 10*y* results in the frictional force between the photosensitive drum 10*y* and the intermediate transfer belt 24 decreasing, and the load on the intermediate transfer belt 24 decreasing. Thus, change in load occurs less readily, and instability of the surface speed of the photosensitive drum 10*y* and the surface speed of the intermediate transfer belt 24 immediately after starting image formation can be suppressed.

Sampling Timing and Load on Photosensitive Drum 10

The image forming apparatus 100 has been configured to acquire PWM signal values of the motor M3 that rotates the photosensitive drum 10. There are the two following reasons for this. The first is that the target speed can be changed for each of the multiple photosensitive drums 10. In a case of changing the target speed of the photosensitive drum 10 based on the PWM signal value of the motor M4 that drives the intermediate transfer belt 24, for example, the photosensitive drum 10 at which frictional force is increasing cannot be identified. The second is that as long as there is no developing agent interposed at the nip portion of the photosensitive drum 10 of interest and intermediate transfer belt 24, the PWM signal value PWMduty1 can be acquired even if there is developing agent interposed at the nip portions of other photosensitive drums 10 and the intermediate transfer belt 24. In a case of changing the target speed of the photosensitive drum 10 based on the PWM signal value of the of the motor M4 driving the intermediate transfer belt 24, for example, the PWM signal value needs to be acquired in a state where there is no developing agent interposed at the nip portions of all of the photosensitive drums 10 and the intermediate transfer belt 24. Accordingly, in a case where image data is consecutively transferred, a state where there is not developing agent interposed at the nip portion between all photosensitive drums 10 and the intermediate transfer belt 24 does not occur, and there will be fewer opportunities to acquire the PWM signal value.

Figure 11:
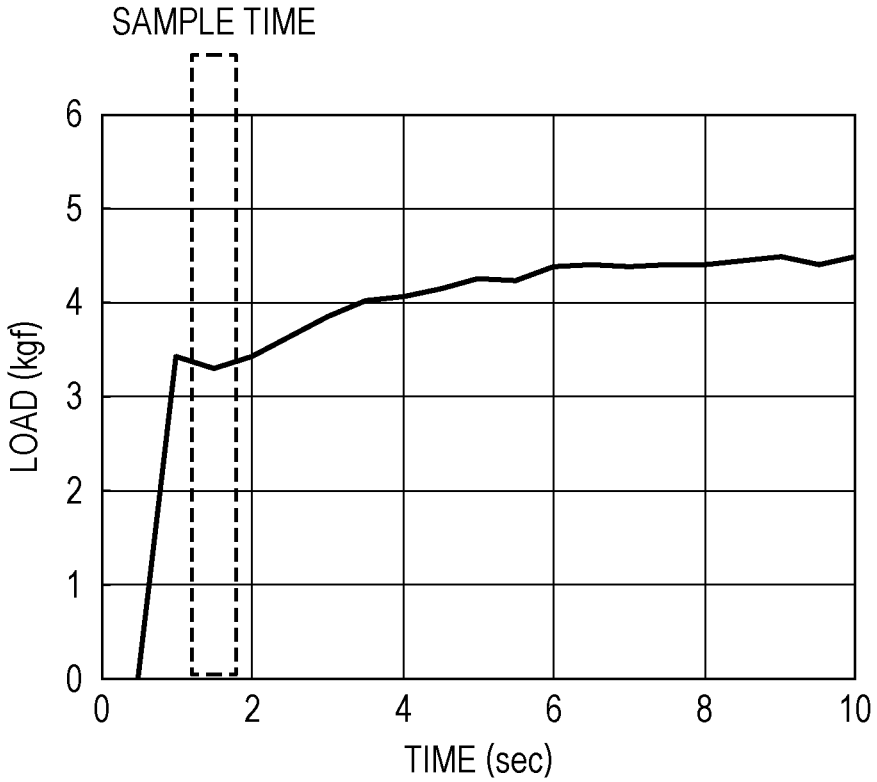
FIG. 11 is an explanatory diagram of sampling timing for PWM signal values.

Now, there is a point that needs to be considered when acquiring load information of the photosensitive drum 10. Primary loads when driving the photosensitive drum 10 are frictional force due to the intermediate transfer belt 24 and frictional force due to the blade of the drum cleaner 26 that comes into contact with the photosensitive drum 10. The image forming apparatus 100 determines whether or not the frictional force between he photosensitive drum 10 and intermediate transfer belt 24 exceeds the permissible range, in a state where the developing sleeve 8 is rotating and developing agent is interposed at the nip portion, and a state where no developing agent is interposed at the nip portion. It can be assumed here that in either state, the frictional force due to the blade of the drum cleaner 26 will be constant. The frictional force between the photosensitive drum 10 and the blade is reduced by developing agent being interposed therebetween. On the other hand, when the developing agent between the photosensitive drum 10 and the blade is spent, the frictional force between the photosensitive drum 10 and the blade rises. FIG. 11 illustrates the change over time of the load on the photosensitive drum 10 in a case where developing agent between the photosensitive drum 10 and blade decreases. It can be seen from FIG. 11 that when the developing agent between the photosensitive drum 10 and the blade decreases, the load on the photosensitive drum 10 rapidly increases. The frictional force then converges at a constant value. That is to say, even in a state where there is no developing agent interposed at the nip portion, the load on the photosensitive drum 10 will rise if the developing agent between the photosensitive drum 10 and the blade is spent. In a case where the PWM signal value is acquired in a period where the load on the photosensitive drum 10 is high, the frictional force between the photosensitive drum 10 and the intermediate transfer belt 24 cannot be highly accurately predicted from the frictional force between the photosensitive drum 10 and the blade.

Accordingly, the image forming apparatus 100 acquires the PWM signal value during a period where developing agent is interposed between the photosensitive drum 10 and the blade, immediately after rotation of the developing sleeve 8 has stopped and developing agent adhered to the photosensitive drum 10 has passed the nip portion. Developing agent is interposed between the photosensitive drum 10 and the blade for a certain amount of time, as illustrated in FIG. 11. Accordingly, the CPU 1000 samples the PWM signal value during this period. This, there is no need for the load of the blade to be taken into consideration for the PWM signal value (PWMduty2).

Sampling of the PWM signal value in a case where the developing sleeve 8 is rotating is preferably performed immediately before rotation of the developing sleeve 8 stops. The reason is that friction is constantly occurring between the photosensitive drum 10 and the blade even in a state where developing agent is interposed between the photosensitive drum 10 and the blade, causing the blade to wear due to the friction, and the load that is placed on the photosensitive drum 10 also changes.

Modification

In a case of using a developing agent with a high level of releasability, there is a possibility that developing agent may fly from the developing sleeve 8 to the photosensitive drum 10 by developing bias even if rotation of the developing sleeve 8 is stopped. It was found by experimentation that the amount of developing agent flying from the developing sleeve 8 to the photosensitive drum 10 could be reduced to 0 by setting the AC voltage for the developing bias to 0. Accordingly, the power source unit 2 (FIG. 2) applies only DC voltage when acquiring the PWM signal value (PWMduty2) in a state where there is not developing agent interposed at the nip portion.

Further, transfer bias supplied from the power source unit 3 (FIG. 2) to the primary transfer roller 23 is set as follows. The transfer bias in a state where there is developing agent interposed at the nip portion, and the transfer bias in a state where there is no developing agent interposed at the nip portion, are the same. According to this configuration, the frictional force between the photosensitive drum 10 and the intermediate transfer belt 24 increases due to electrostatic force. The target speed deciding unit 1002 thus acquires the PWM signal value (PWMduty2) in a state where the power source unit 3 is applying transfer bias to the primary transfer roller 23.

Figure 8:
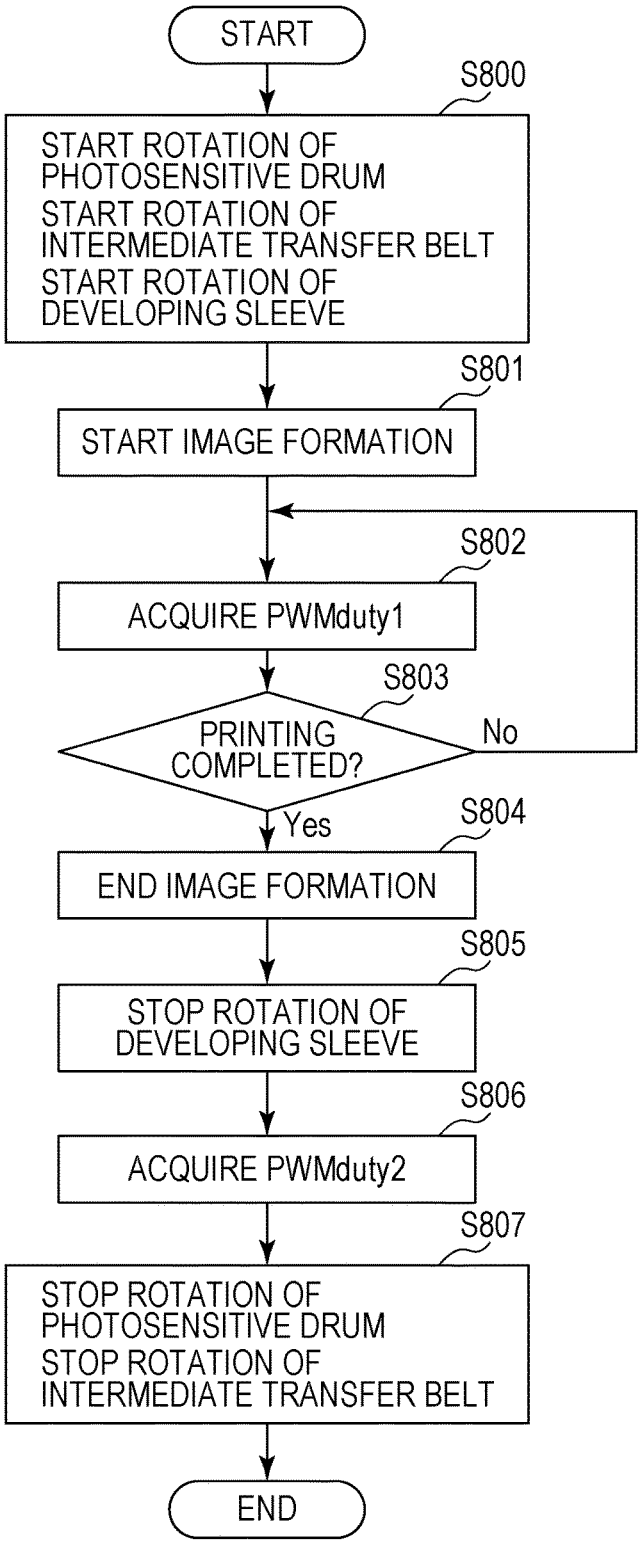
FIG. 8 is a flowchart illustrating image forming operations.

Now, the image forming apparatus 100 illustrated in FIG. 8 updates the PWM signal value (PWMduty1) each time an image is formed. However, a configuration may be made where sampling of the PWM signal value is performed multiple times while the photosensitive drum 10 makes one rotation. According to this configuration, PWMduty1 is decided from the average value of multiple PWM signal values. This configuration enables change in the PWM signal value to be acquired with high precision. The reason is that the PWM signal value changes when the photosensitive drum 10 is being rotated by the motor M3, due to backlash of gears transmitting the driving force of the motor M3, and eccentricity of the photosensitive drum 10.

According to the image forming apparatus 100 of the present embodiment, downtime to decide the target speed of the photosensitive drum 10 can be reduced.

Second Embodiment

The image forming apparatus 100 according to a second embodiment will be described below with reference to FIGS. 12 through 15B. The developing sleeve 8 cannot be stopped while consecutively forming multiple images with the image forming apparatus 100 according to the first embodiment. Accordingly, the image forming apparatus 100 according to the first embodiment cannot update the target speed of the photosensitive drum 10 while consecutively forming multiple images. Accordingly, there is a possibility that the frictional force between the photosensitive drum 10 and the intermediate transfer belt 24 might increase while consecutively forming multiple images. Accordingly, the image forming apparatus 100 according to the second embodiment temporarily stops image forming operations while consecutively forming multiple images, forcibly transitions the image forming apparatus 100 to the second state, and acquires the PWM signal value (PWMduty2).

Image formation processing that the image forming apparatus 100 according to the second embodiment executes will be described with reference to the flowchart in FIG. 12. The configuration of the image forming apparatus 100 is the same as that of the image forming apparatus 100 according to the first embodiment. Accordingly, description of the configuration of the image forming apparatus 100 according to the second embodiment will be omitted. The image forming apparatus 100 according to the second embodiment has an upper limit to the number of PWM signal values that can be stored in the RAM 1200. Accordingly, once the number of PWM signal values stored in the RAM 1200 reaches the upper limit, the oldest PWM signal value stored in the RAM 1200 is deleted, and a new PWM signal value is stored. The RAM 1200 stores 72 sets of data for each motor, for example.

First, the CPU 1000 rotates the photosensitive drum 10, intermediate transfer belt 24, and developing sleeve 8 (S1200). The motor driver 1300 controls PWM signals input to the motor M3. The motor M3 rotates the photosensitive drum 10 based on the PWM signal value input from the motor driver 1300. The motor driver 1300 belt controls PWM signals input to the motor M4. The motor M4 rotates the drive roller 40 of the intermediate transfer belt 24 based on the PWM signals input from the motor driver 1300 belt. The motors M1 and M2 rotate the developing sleeve 8 and agitation member 6 of the developing unit 1 in step S1200.

The motor driver 1300 updates the PWM signal value every 1 msec, for example. The PWM signal value output from the motor driver 1300 is not only supplied to the motor M3 but also is stored in the RAM 1200.

The CPU 1000 controls the image forming unit 5 (5*y*, 5*m*, 5*c*, 5*bk*) to form an image by sequentially overlaying images of the color components upon the intermediate transfer belt 24 (S1201). After the first amount of time has elapsed after the image data has been transferred, the CPU 1000 stores the PWM signal value output from the motor driver 1300 (PWMduty1) in the RAM 1200 (S1202). When the developing sleeve 8 starts to rotate, developing agent is supplied from the developing sleeve 8 to the photosensitive drum 10, and the developing agent supplied to the photosensitive drum 10 is conveyed to the nip portion. The CPU 1000 stores the PWM signal value (PWMduty1) in the RAM 1200, after the first amount of time has elapsed from the time point at which the developing sleeve 8 started to rotate, in order to acquire the PWM signal value (PWMduty1) in the state where developing agent is interposed at the nip portion.

The photosensitive drum 10, intermediate transfer belt 24, and developing sleeve 8 rotate as long as image formation is being executed. The CPU 1000 stores the PWM signal value (PWMduty1) in the RAM 1200 every 8 msec, for example. The PWM signal value (PWMduty1) in the first state corresponds to the first signal value (first information) that changes in accordance with the torque of the motor M3.

Next, the CPU 1000 determines whether or not formation of all images included in the image data has been completed (S1203). If formation of all images is completed in step S1203, the CPU 1000 stops image formation at the image forming unit 5 (S1204). In step S1204, the CPU 1000 stops charging processing of the photosensitive drum 10 by the charger 21, and stops irradiation by laser beam by the exposing device 22. The CPU 1000 then stops the processing of storing the PWM signal value (PWMduty1) in the RAM 1200.

Next, the CPU 1000 stops the rotation of the developing sleeve 8 (S1205). In step S1205, the CPU 1000 causes the motor driver 1300 to stop rotation of the motor M2. The photosensitive drum 10 and the drive roller 40 of the intermediate transfer belt 24 are continuing rotation at this time.

After the second amount of time has elapsed after rotation of the developing sleeve 8 has stopped in step S1205, the CPU 1000 stores the PWM signal value (PWMduty2) output from the motor driver 1300 in the RAM 1200 (S1206). When the rotation of the developing sleeve 8 stops, supply of developing agent from the developing sleeve 8 to the photosensitive drum 10 stops. However, there is a time lag from the developing sleeve 8 to stop rotating until the developing agent on the photosensitive drum 10 passes through the nip portion. The CPU 1000 stores the PWM signal value (PWMduty2) in the RAM 1200 after the second amount of time has passed from the time point that the developing sleeve 8 stops rotating, in order to acquire the PWM signal value (PWMduty2) in a state where there is no developing agent interposed at the nip portion.

The CPU 1000 stores the PWM signal value (PWMduty2) in the RAM 1200 in the second state where the photosensitive drum 10 is rotating, the intermediate transfer belt 24 is being driven, and the developing sleeve 8 is stopped, every 8 msec, for example. The PWM signal value in the second state (PWMduty2) corresponds to the second signal value (second information) that changes in accordance with the torque of the motor M3. Upon 36 sets of the PWM signal (PWMduty2) in a state where no developing agent is interposed at the nip portion being stored in the RAM 1200, the CPU 1000 stops storage of the PWM signal (PWMduty2).

Next, the target speed deciding unit 1002 executes target speed adjustment processing for the photosensitive drums 10 of the image forming units 5 (5*y*, 5*m*, 5*c*, 5*bk*) (S1207). The CPU 1000 then stops rotation of the photosensitive drum 10, stops driving of the intermediate transfer belt 24 (S1208), and ends image forming operations. The target speed adjustment processing in step S1207 is the same as the adjustment processing illustrated in FIG. 9 of the first embodiment, so description will be omitted here.

In a case where all images have not been formed in step S1203, the CPU 1000 determines whether or not the number of images printed consecutively without stopping the developing sleeve 8 has reached 200 (S1209). In a case where the number of images printed consecutively without stopping the developing sleeve 8 is smaller than 200 in step S1209, the CPU 1000 transitions the processing to step S1202.

On the other hand, in a case where determination is made in step S1209 that the number of images printed consecutively without stopping the developing sleeve 8 has reached 200, the CPU 1000 stops rotation of the developing sleeve 8 (S1210). The image forming apparatus 100 temporarily stops the developing sleeve 8 in order to resolve the immobile layer of developing agent that is created within the developing unit 1. In a case where the developing agent in the immobile layer within the developing unit 1 becomes cohered, image defects may occur. For example, if the cohered developing agent comes into contact with the developing sleeve 8 and the thickness of the layer of developing agent borne by the developing sleeve 8 changes, streaks may be formed on the photosensitive drum 10. Accordingly, the image forming apparatus 100 temporarily stops image forming operations and stops the developing sleeve 8 for around two seconds, for example, to resolve the immobile layer of developing agent within the developing unit 1. Thereafter, the image forming apparatus 100 rotates the developing sleeve 8 again and resumes image forming operations.

In step S1210, the CPU 1000 causes the motor driver 1300 to stop rotation of the motor M2. At this time, the photosensitive drum 10 and the drive roller 40 of the intermediate transfer belt 24 continue to rotate. After a second amount of time has elapsed after rotation of the developing sleeve 8 has stopped in step S1210, the CPU 1000 stores the PWM signal value (PWMduty2) output from the motor driver 1300 in the RAM 1200 (S1211).

In the second state where the photosensitive drums 10 is rotating, the intermediate transfer belt 24 is being driven, and the developing sleeve 8 is stopped, the PWM signal value (PWMduty2) is stored is in the RAM 1200, every 8 msec, for example. The PWM signal value in the second state (PWMduty2) corresponds to the second signal value (second information) that changes in accordance with the torque of the motor M3. Upon 36 sets of the PWM signal value (PWMduty2) in a state where no developing agent is interposed at the nip portion being stored in the RAM 1200 for example, the CPU 1000 stops storage of the PWM signal (PWMduty2).

Next, the target speed deciding unit 1002 executes target speed adjustment processing for the photosensitive drums 10 of the image forming units 5 (5*y*, 5*m*, 5*c*, 5*bk*) (S1212). The CPU 1000 then stops rotation of the photosensitive drum 10, and stops driving of the intermediate transfer belt 24, and ends the image forming processing. The target speed adjustment processing in step S1212 is the same as the target speed adjustment processing illustrated in FIG. 9.

After the developing sleeve 8 has stopped for two seconds (S1213), the CPU 1000 resumes rotation of the developing sleeve 8 (S1214), resumes formation of images based on the image data, and the CPU 1000 transitions the processing to step S1202.

Even in a case where the image forming apparatus 100 is consecutively forming multiple images, the rotation of the developing sleeve 8 can be temporarily stopped and the PWM signal value (PWMduty2) relating to torque of the motor M3 in a state where no developing agent is interposed at the nip portion can be acquired. Further, the target rotation speed of the photosensitive drums 10 can be corrected even in a case where the image forming apparatus 100 is consecutively forming multiple images. Accordingly, the image forming apparatus 100 of the present embodiment can suppress image defects occurring due to frictional force between he photosensitive drum 10 and the intermediate transfer belt 24.

Figure 13:
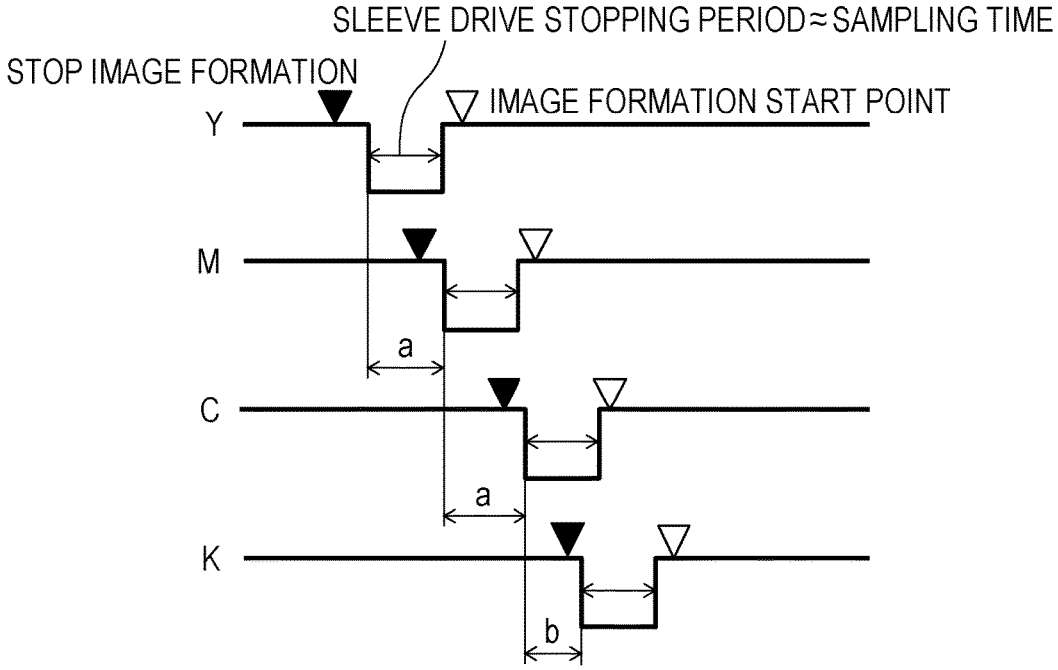
FIG. 13 is a timing chart relating to timings of stopping developing sleeves.

Now, the timing of stopping the developing sleeves 8 of the image forming units 5*y*, 5*m*, 5*c*, and 5*bk* will be described with reference to the timing chart in FIG. 13. After the developing sleeve 8 of the image forming unit 5*y* that is farthest upstream in the conveyance direction of the intermediate transfer belt 24 stops, the developing sleeve 8 of the image forming unit 5*m* situated downstream from the image forming unit 5*y* in the conveyance direction stops. Further, after the developing sleeve 8 of the image forming unit 5*m* stops, the developing sleeve 8 of the image forming unit 5*c* situated downstream from the image forming unit 5*m* in the conveyance direction stops. In the same way, after the developing sleeve 8 of the image forming unit 5*c* stops, the developing sleeve 8 of the image forming unit 5*bk* situated downstream from the image forming unit 5*c* in the conveyance direction stops. Thus, acquisition can be made of PWM signal values (PWMduty2) after the developing agent transferred to the intermediate transfer belt 24 has passed the nip portions.

The developing sleeves 8 then sequentially start rotating, after sampling of the PWM signal values has been completed. After the developing sleeve 8 of the image forming unit 5*y* that is farthest upstream in the conveyance direction of the intermediate transfer belt 24 resumes rotation, the developing sleeve 8 of the image forming unit 5*m* situated downstream from the image forming unit 5*y* in the conveyance direction resumes rotation. Further, after the developing sleeve 8 of the image forming unit 5*m* resumes rotation, the developing sleeve 8 of the image forming unit 5*c* situated downstream from the image forming unit 5*m* in the conveyance direction resumes rotation. In the same way, after the developing sleeve 8 of the image forming unit 5*c* resumes rotation, the developing sleeve 8 of the image forming unit 5*bk* situated downstream from the image forming unit 5*c* in the conveyance direction resumes rotation. Thus, the stopped time of the developing sleeves 8 can be minimized by controlling the rotation of the developing sleeves 8 and the sampling timing of PWM signal values. Sampling Timing and Load on Photosensitive Drum 10

The PWM signal value (PWMduty2) of a state where there is no developing agent interposed between the photosensitive drum 10 and intermediate transfer belt 24 is acquired with the rotation of the developing sleeve 8 stopped and the AC voltage of the power source unit 2 (FIG. 2) set to 0 V. That is to say, the PWM signal value (PWMduty2) of a state where there is no developing agent interposed between the photosensitive drum 10 and intermediate transfer belt 24 is acquired with the rotation of the developing sleeve 8 stopped and the DC voltage of the power source unit 2 supplied to the developing sleeve 8. This is to suppress developing agent from being supplied from the developing sleeve 8 to the photosensitive drum 10 depending on the value of the developing bias when the developing sleeve 8 is stopped, in a case of using a toner with a high level of releasability as the developing agent.

Figure 14A:
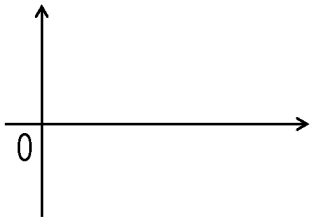
FIGS. 14A through 14C are schematic diagrams for describing developing bias.
Figure 14B:
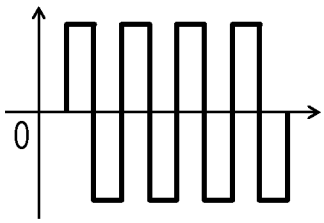
Figure 14C:
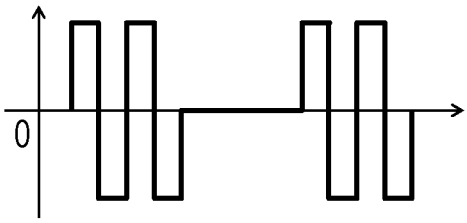

FIGS. 14A through 14C are diagrams illustrating waveforms of developing bias. The developing bias illustrated in FIG. 14A is DC voltage not including AC voltage. The developing bias illustrated in FIG. 14B is AC voltage superimposed on DC voltage. This developing voltage is called "square bias". The developing bias illustrated in FIG. 14C includes a period where the AC voltage in part of the square bias goes to 0 V. Developing bias including a period where the AC voltage in part of the square bias goes to 0 V is called "blank pulse bias". Accordingly, the PWM signal value (PWMduty2) is acquired in the above-described blank pulse bias period.

Further, the amount of change in frictional force between the photosensitive drum 10 and the intermediate transfer belt 24 depending on whether developing agent is present or absent at the nip portion is predicted based on the difference in PWM signal values of the motor M3. Accordingly, the PWM signal value in a state where developing agent is interposed at the nip portion and the PWM signal value in a state where no developing agent is interposed at the nip portion must not change due to any other influence besides whether developing agent is present or absent.

However, there is a possibility that frictional force between the photosensitive drum 10 and intermediate transfer belt 24 may change due to transfer bias supplied from the power source unit 3 (FIG. 2) to the primary transfer roller 23. The reason is that when transfer bias is applied to the primary transfer roller 23 in a state where no developing agent is supplied to the nip portion, electrostatic adsorption between the photosensitive drum 10 and intermediate transfer belt 24 may increase. Note that the power source unit 3 continues to apply transfer bias between the photosensitive drum 10 and the intermediate transfer belt 24 while the image forming unit 5 is forming images. The power source unit 3 then sets the transfer bias to 0 V when the image forming unit 5 ends forming of images.

Figure 15A:
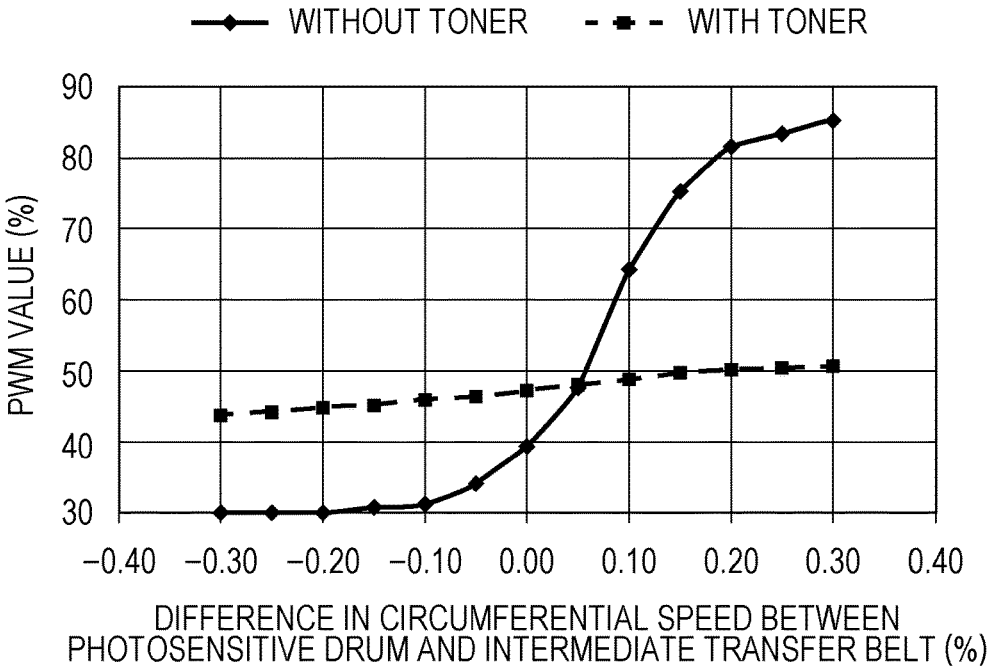
FIGS. 15A and 15B are diagrams exemplifying experiment data where PWM signals and circumferential speed difference.
Figure 15B:
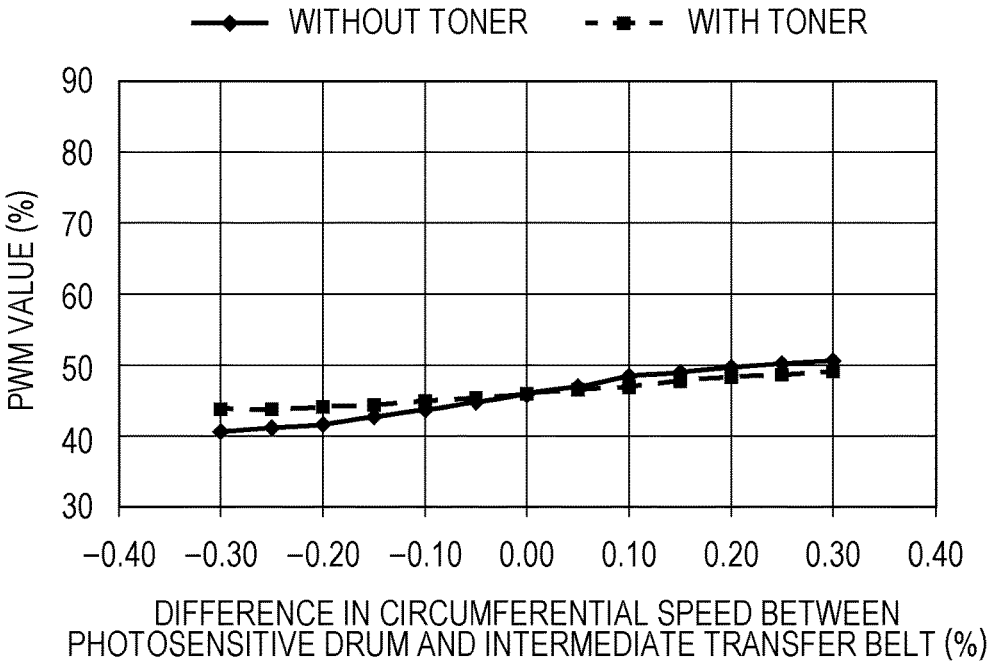

FIGS. 15A and 15B are experiment results illustrating the PWM signal value of the motor M4 that rotates the drive roller 40, where the circumferential speed difference between the photosensitive drum 10 and intermediate transfer belt 24 was varied. FIG. 15A illustrates PWM signal values of the motor M4 in a state where transfer bias is applied, and FIG. 15B illustrates PWM signal values of the motor M4 in a state where transfer bias is not applied. It can be seen from FIGS. 15A and 15B that the difference between PWM signal values in a state with transfer bias applied and the difference between PWM signal values in a state with no transfer bias applied are not the same. Further, in cases where developing agent is interposed at the nip portion, there is not very much change in frictional force between the photosensitive drum 10 and the intermediate transfer belt 24, regardless of whether or not transfer bias is being applied. Accordingly, in a case of the CPU 1000 storing a PWM signal value in the RAM 1200 in a state where no developing agent is interposed at the nip portion, the CPU 1000 controls the power source unit 3 so that transfer bias is not applied, in order to suppress the influence of transfer bias in the image forming apparatus 100.

According to the image forming apparatus 100 of the present embodiment, even in a case of consecutively forming multiple images, a timing is provided for stopping the rotation of the developing sleeve 8 during multiple images being formed, and the PWM signal value of the motor M3 is acquired at this time. Thus, the PWM signal value of the motor M3 can be acquired in a state where no developing agent is interposed between the photosensitive drum 10 and the intermediate transfer belt 24. Further, the target rotation speed of the motor M3 can be adjusted even while the image forming apparatus 100 is forming multiple images. Accordingly, the possibility of frictional force increasing between the photosensitive drum 10 and intermediate transfer belt 24 while the image forming apparatus 100 is forming multiple images, resulting in image defects, can be suppressed.

Modification

Figure 12:
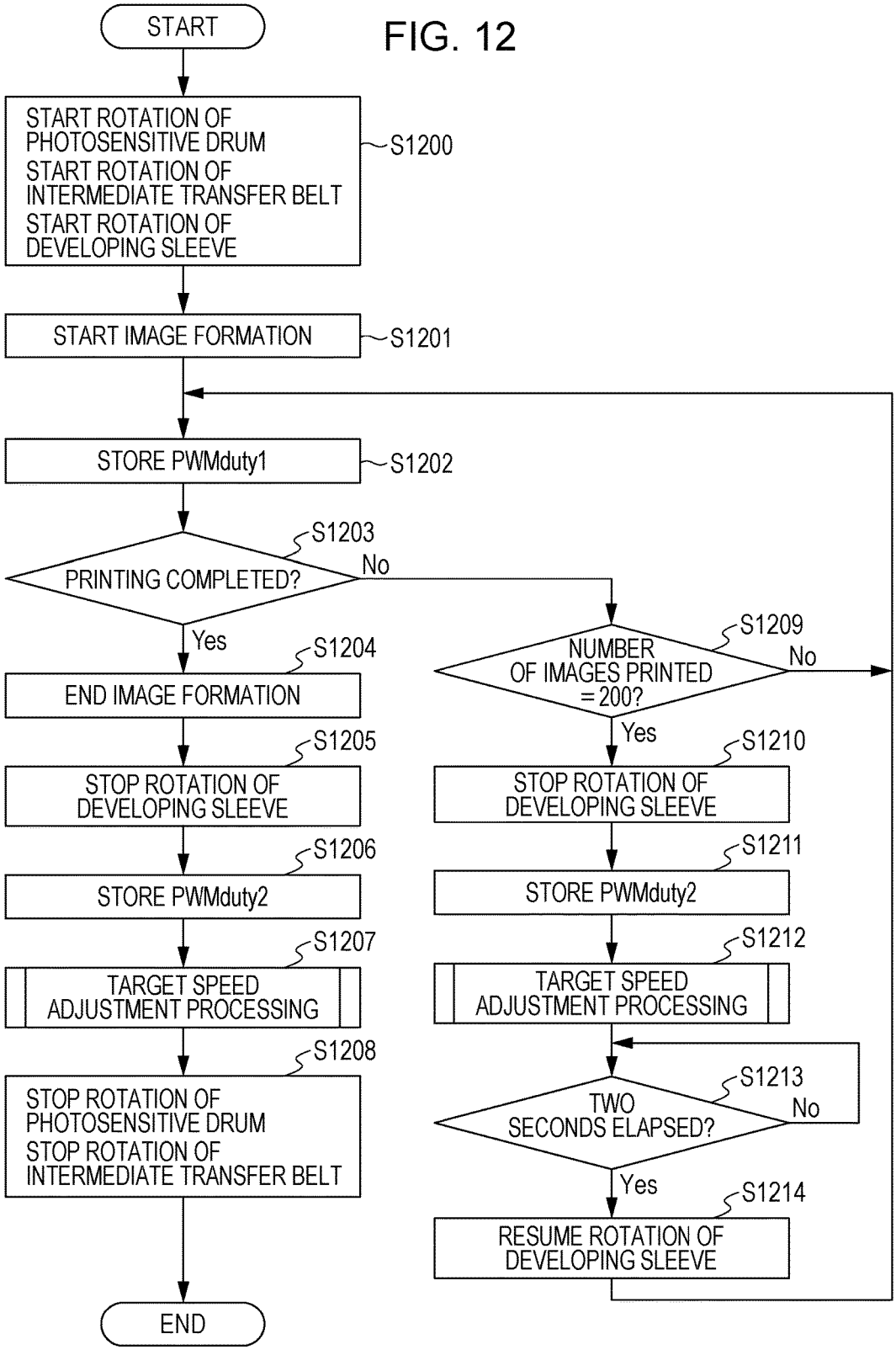
FIG. 12 is a flowchart illustrating image forming operations according to a second embodiment.

Description has been made with reference to FIG. 12 that in a case of the image forming apparatus 100 consecutively forming multiple images, rotation of the developing sleeve 8 is stopped each time the number of images consecutively printed without the developing sleeve 8 being stopped reaches 200. This is executed to resolve the immobile layer of developing agent that is created within the developing unit 1. However, the conditions for stopping the developing sleeve 8 from rotating to resolve the immobile layer of developing agent that is created within the developing unit 1 is not restricted to the above-described conditions.

The stopping conditions may be the amount of time that the image forming apparatus 100 has continuously driven the image forming unit 5 to form multiple images. For example, in a case where the time over which the image forming unit 5 has been continuously driven exceeds a predetermined amount of time, the CPU 1000 temporarily stops rotation of the developing sleeve 8. The developing sleeve 8 continues to rotate as long as the image forming unit 5 is being continuously driven, so there is a high probability that an immobile layer of developing agent will be created within the developing unit 1. Accordingly, the image forming operations are temporarily stopped at a timing where the continuous rotating time of the developing sleeve 8 reaches a predetermined amount of time, and the rotation of the developing sleeve 8 is stopped, to resolve the immobile layer of developing agent that is created within the developing unit 1.

The stopping conditions may be the amount of developing agent consumed while the image forming apparatus 100 consecutively forms multiple images. For example, an arrangement may be made where the amount of consumption of developing agent is predicted based on the image data, and in a case where the amount of developing agent consumed for images formed on a predetermined number of sheets is smaller than a predetermined amount, the CPU 1000 temporarily stops rotation of the developing sleeve 8. It is known that there is a high probability of an immobile layer of developing agent being created within the developing unit 1 when the amount of developing agent consumed is small. Accordingly, when the amount of developing agent being consumed is smaller than the predetermined amount, the image forming operations are temporarily stopped at an optional timing during consecutive forming of multiple images, and the rotation of the developing sleeve 8 is stopped, to resolve the immobile layer of developing agent that is created within the developing unit 1.

According to the image forming apparatus 100 of the present embodiment, downtime to decide the target speed of the photosensitive drum 10 can be reduced. Further, according to the image forming apparatus 100 of the present embodiment, even if multiple images are being consecutively formed, a timing to stop rotation of the developing sleeve 8 is provided during the multiple images being consecutively formed, and the PWM signal value of the motor M3 is acquired at this timing. Accordingly, the PWM signal value of the motor M3 can be acquired in a state where no developing agent is interposed between the photosensitive drum 10 and the intermediate transfer belt 24. Thus, the target rotation speed of the motor M3 can be adjusted even if the image forming apparatus 100 is consecutively forming multiple images. Consequently, the possibility of frictional force increasing between the photosensitive drum 10 and intermediate transfer belt 24 while the image forming apparatus 100 is consecutively forming multiple images, resulting in image defects, can be suppressed.

Third Embodiment

The image forming apparatus 100 according to a third embodiment will be described below with reference to FIGS. 16A through 20B. The target speeds of the motors M3 and M4 need to be appropriately adjusted as the temperature within the image forming apparatus 100 (temperature in apparatus) rises. The reason thereof will be described.

when the image forming apparatus 100 consecutively forms images on a great number of sheets P, the temperature in the apparatus rises. When the temperature in the apparatus rises, the friction coefficient μb at the surface of the intermediate transfer belt 24 also rises. Consequently, when the temperature in the apparatus rises, the rotation torque necessary to drive the photosensitive drum 10 also rises.

Figure 16A:
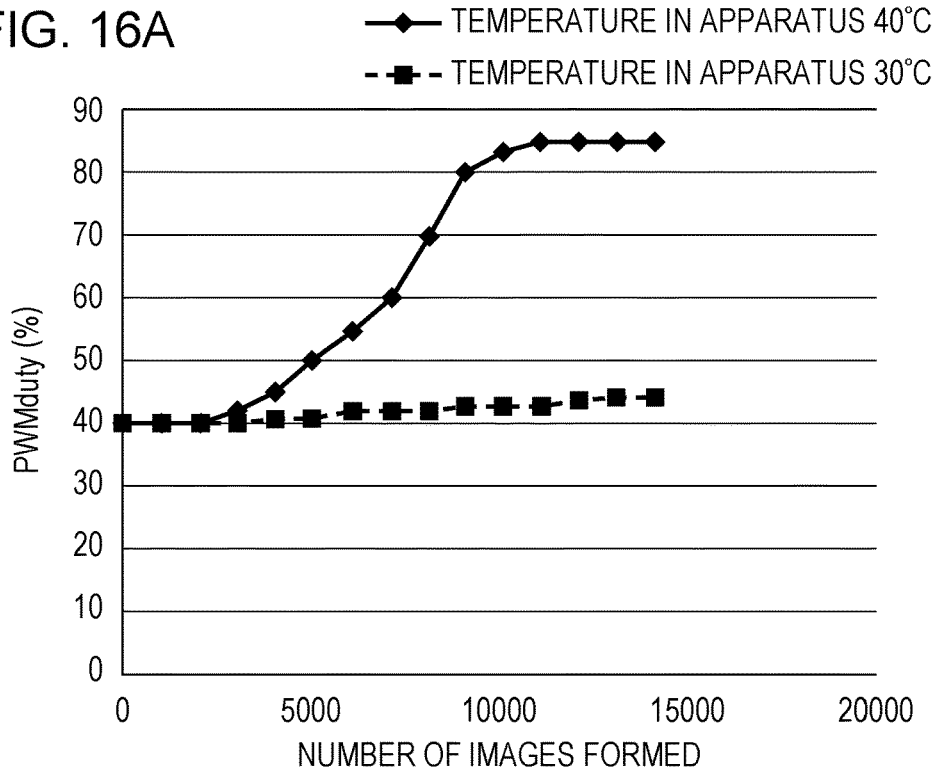
FIGS. 16A and 16B are diagrams exemplifying measurement results of number of images formed and motor PWM signal values.

FIG. 16A illustrates rotation torque (PWM duty) as to the number of images formed. Rotation torque may also be referred to as load torque. The dashed line indicates the rotation torque in a case where the temperature in the apparatus is 30° C. The solid line indicates the rotation torque in a case where the temperature in the apparatus is 40° C. It can be seen from FIG. 16A that even if image formation is continued in a state where the temperature in the apparatus is low, the rotation torque of the photosensitive drum 10 does not rise very much. On the other hand, if image formation is performed in a state where the temperature in the apparatus is high, the rotation torque of the photosensitive drum 10 rises due to frictional force at the nip portion.

Figure 16B:
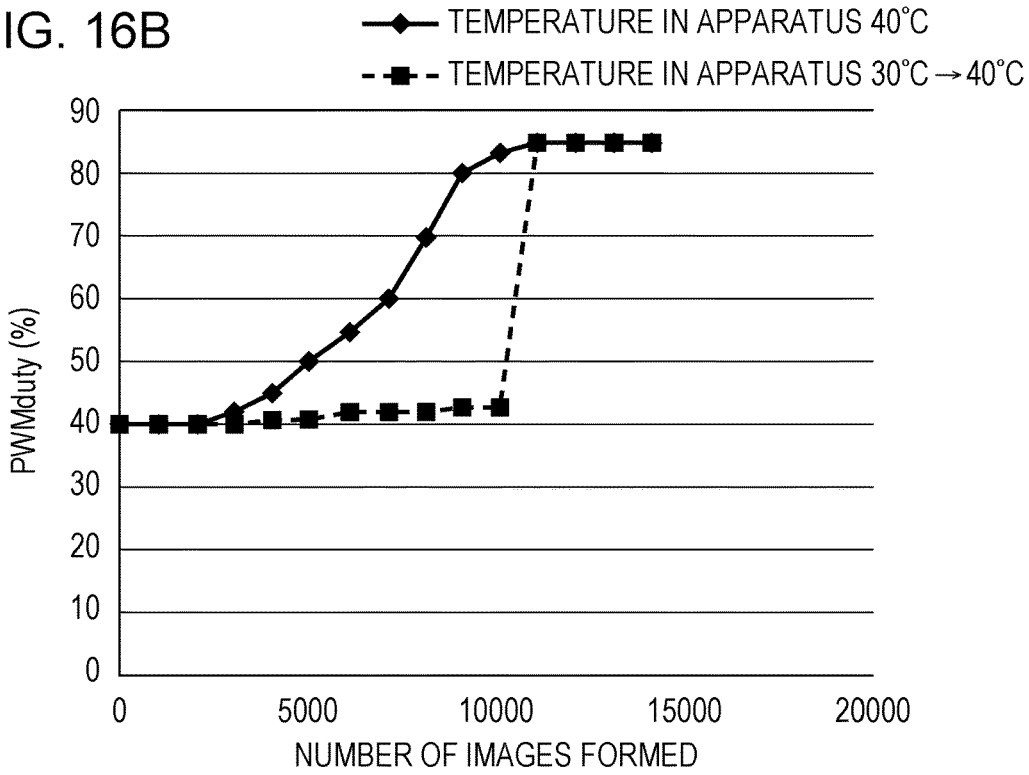

FIG. 16B illustrates PWM duty as to the number of images formed. The dashed line indicates PWM duty in a case of switching to an image forming mode that lends to increase in temperature in the apparatus (e.g., thick paper mode or the like), from a state where the temperature in the apparatus is low. The solid line indicates the rotation torque in a case where the temperature in the apparatus is 40° C. In this example, the mode is switched from plain paper mode to thick paper mode when the number of images formed reaches 10,000 in a state where the temperature in the apparatus is 30° C. The fixing temperature in the thick paper mode is higher than the fixing temperature in the plain paper mode. Accordingly, the temperature in the apparatus tends to rise in a case of the image forming apparatus 100 running based on the thick paper mode. It can thus be seen that even if the ambient temperature is low, the rotation torque of the photosensitive drum 10 may rise depending on the image forming mode.

When a load where the PWM duty exceeds 60% is placed on the motor M3 that drives the photosensitive drum 10, there is a possibility of color misregistration or banding occurring. Accordingly, the image forming apparatus 100 must appropriately control the rotation speed of the motor M3 driving the photosensitive drum 10, so that color misregistration or banding occurring does not occur.

As described above, downtime can be reduced by adjusting the rotation speed of the motor M3 driving the photosensitive drum 10 at the timing when color registration adjustment is executed. However, intervals between execution of color registration adjustment are relatively long. Accordingly, there is the possibility that color misregistration or banding will occur in a case where rotation torque suddenly rises. The image forming apparatus 100 according to the present embodiment adjusts the rotation speed of the motor M3 driving the photosensitive drum 10 as necessary, without waiting for execution of color registration adjustment. The configuration of the image forming apparatus 100 according to the third embodiment is the same as that of the image forming apparatus 100 according to the first embodiment. Accordingly, description of the configuration of the image forming apparatus 100 according to the third embodiment will be omitted.

Figure 17:
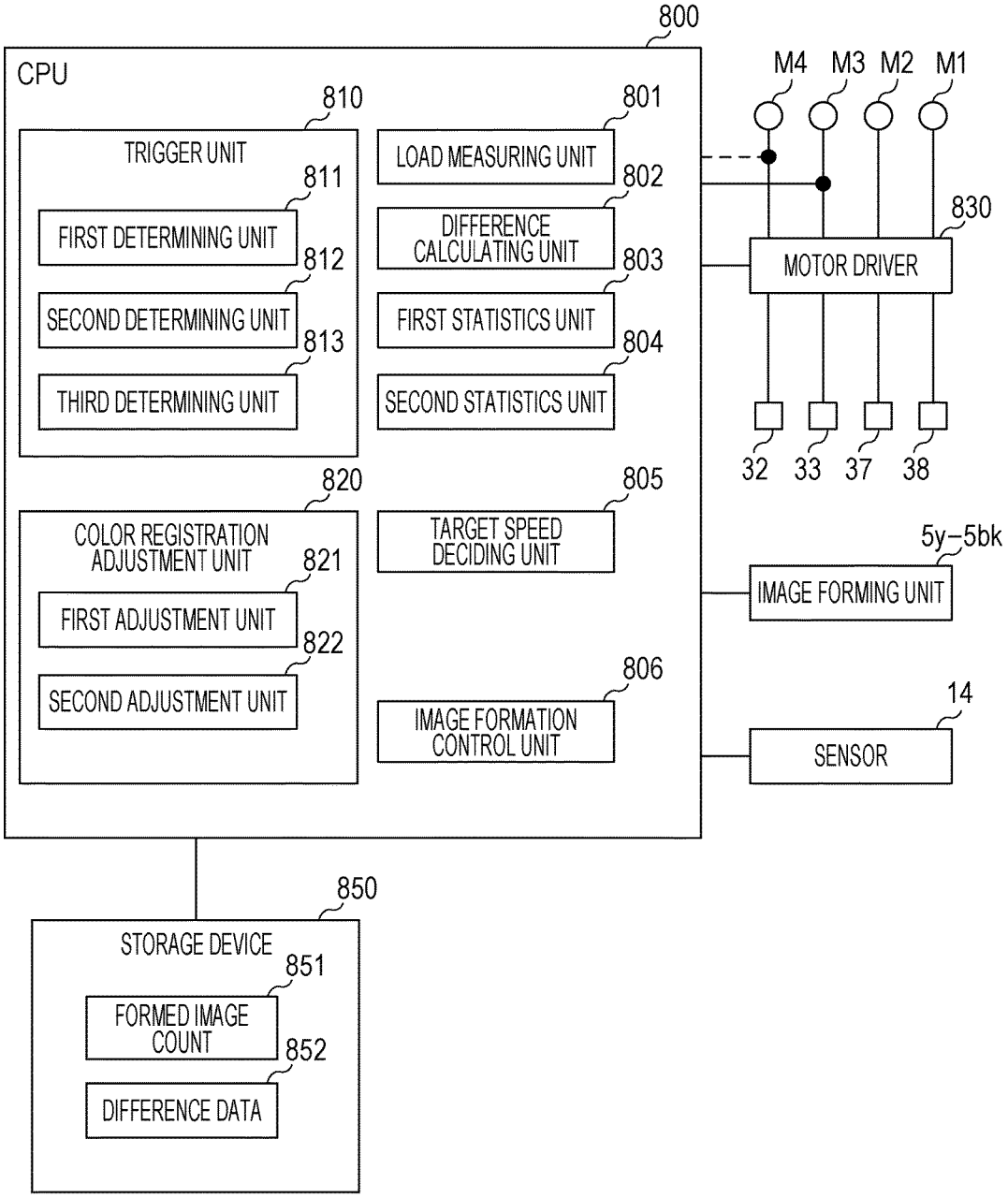
FIG. 17 is a control block diagram of an image forming apparatus according to a third embodiment.

FIG. 17 is a control block diagram illustrating the image forming apparatus 100 according to the third embodiment. A CPU 800 realizes various types of functions by executing a control programs stored in a storage device 850. Note that part or all of these functions may be realized by hardware such as an ASIC or field-programmable gate array (FPGA) or the like. The storage device 850 has memory such as RAM, ROM, or the like. Stored in the storage device 850 are formed image count 851, difference data 852, and so forth. The formed image count 851 is the number of sheets P on which images have been formed by the image forming apparatus 100. The difference data 852 is difference data of the rotation torque of the motor M3.

A motor driver 830 drives the motors M1, M2, M3, and M4 in accordance with instructions and setting values (target speed) from the CPU 800. The motor driver 830 executes feedback control based on speed information obtained from the speed sensors 32, 33, 37, and 38.

A load measuring unit 801 is a unit that detects (measures) information relating to rotation torque of the motor M3 by acquiring the duty of PWM signals supplied to the motor M3. Rotation torque may be referred to as load torque. The object of measurement may be the motor M4 that drives the intermediate transfer belt 24, instead of the motor M3. A difference calculating unit 802 calculates the difference between two PWM duties measured by the load measuring unit 801. The first is the PWM duty (PWMduty1) measured by the load measuring unit 801 in the driving state where the developing sleeve 8 is being driven by the motor M2 (first state). The second is the PWM duty (PWMduty2) measured by the load measuring unit 801 in the non-driving state where the developing sleeve 8 is not being driven by the motor M2 (second state). Toner is supplied to the photosensitive drum 10 in the driving state, but no toner is supplied to the photosensitive drum 10 in the non-driving state. That is to say, the difference calculating unit 802 acquires the difference between PWM duty in a state where there is toner at the nip portion and PWM duty in a state where there is no toner at the nip portion.

The storage device 850 stores differences acquired by the difference calculating unit 802. A first statistics unit 803 obtains an average value of the N newest difference data out of the difference data 852 stored in the storage device 850, as a statistics value. A second statistics unit 804 an average value of M difference data 852 stored in the storage device 850, as a statistics value. Note that M>N. For example, M is 30 and N is 5. When the statistics value (e.g., average value) obtained by the first statistics unit 803 reaches or exceeds a first threshold value (e.g., 10%), a target speed deciding unit 805 decides a setting value for the rotation speed of the motor M3 (target speed) so that the difference will be reduced. An image formation control unit 806 controls the exposing devices 22, developing units 1, power source units 2, and power source units 3, of the image forming units 5*y*, 5*m*, 5*c*, and 5*bk*.

Figure 9:
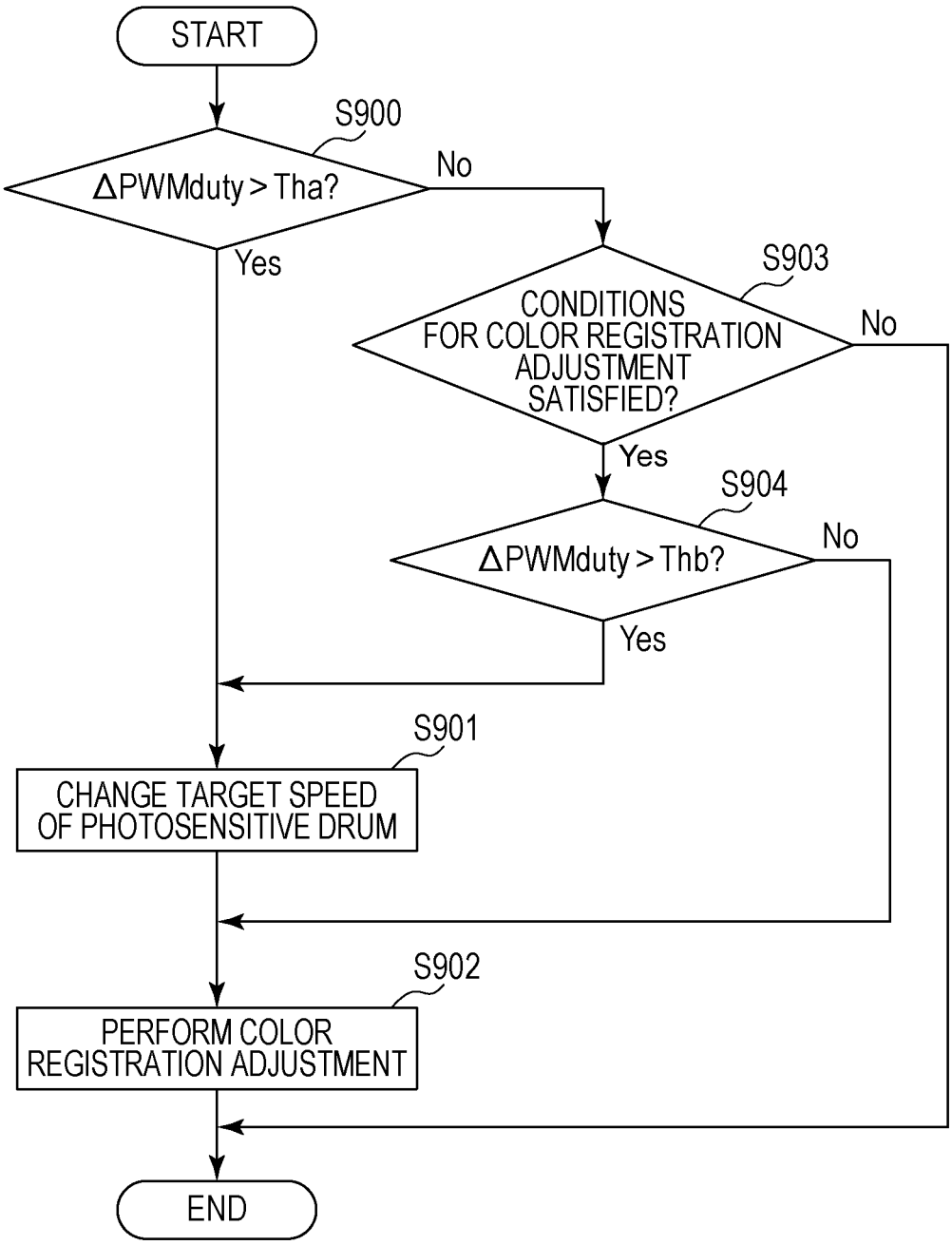
FIG. 9 is a flowchart illustrating target speed adjustment processing.

A trigger unit 810 manages timing for executing color registration adjustment, and timing for executing adjustment processing (FIG. 9). A first determining unit 811 determines whether or not execution of adjustment processing is necessary. For example, the first determining unit 811 determines whether or not the statistics value of the newest N differences stored in the storage device 850 is equal to or exceeds the first threshold value. A second determining unit 812 determines whether or not consecutive execution of adjustment processing and color registration adjustment is necessary. For example, the second determining unit 812 determines whether or not the statistics value of the M differences stored in the storage device 850 is equal to or exceeds a second threshold value. A third determining unit 813 determines whether or not execution conditions for color registration adjustment are satisfied. The storage device 850 can store a maximum of M sets of difference data. Of the M sets of difference data, the difference data having the oldest acquisition clock time is overwritten by newer difference data.

A color registration adjustment unit 820 corrects the image formation positions (write timings) of each color, so that the image forming positions among Y, M, C, and Bk are aligned. A second adjustment unit 822 forms color patterns 48*y*, 48*m*, 48*c*, and 48*bk*, controls the sensor 14 to detect the color patterns 48*y*, 48*m*, 48*c*, and 48*bk*, and adjusts the write timing for each color based on the detection results. A first adjustment unit 821 adjusts the write timings for the colors based on the target speed decided by the target speed deciding unit 805. That is to say, the first adjustment unit 821 adjusts the write timing without forming the color patterns 48*y*, 48*m*, 48*c*, and 48*bk*. Accordingly, the adjustment time by the first adjustment unit 821 is shorter than the adjustment time by the second adjustment unit 822. This is useful in reducing downtime. Color registration adjustment that the second adjustment unit 822 performs using color patterns is more precise as compared to the prediction color registration adjustment that the first adjustment unit 821 performs.

The image forming apparatus 100 according to the present embodiment executes rotation speed adjustment processing for the photosensitive drums 10 in a case where color registration adjustment is executed. Further, the image forming apparatus 100 according to the present embodiment executes rotation speed adjustment processing for the photosensitive drums 10 in a case where the rotation torque of the motor M3 changes greatly, even if not the timing for executing color registration adjustment. Accordingly, the circumferential speed of the photosensitive drums 10 as to the intermediate transfer belt 24 can be adjusted at a more appropriate timing.

Rotational Torque Measurement Processing

Figure 18:
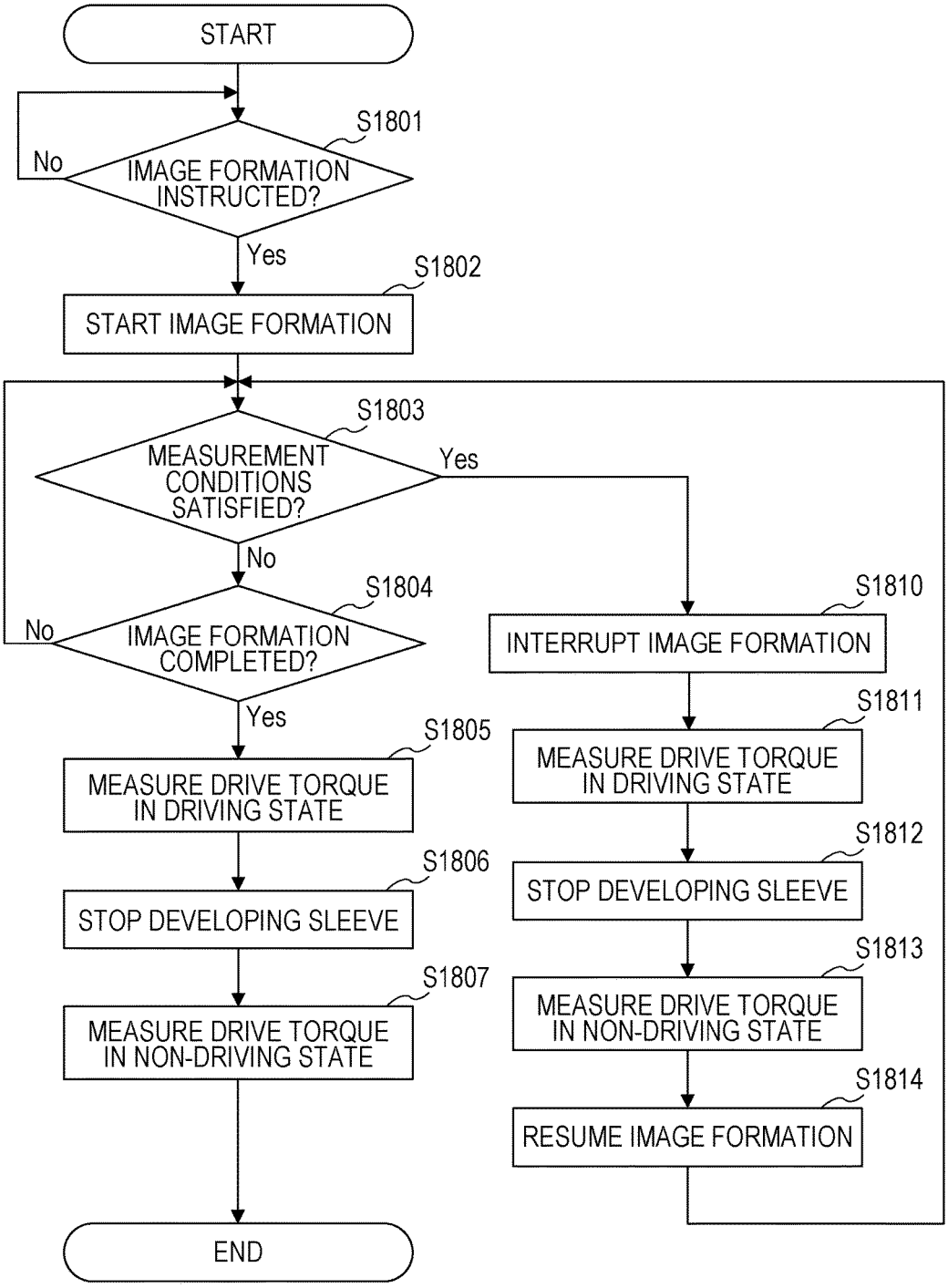
FIG. 18 is a flowchart illustrating image forming operations according to the third embodiment.

FIG. 18 is a flowchart illustrating rotation torque measurement processing. In step S1801, the CPU 800 (image formation control unit 806) determines whether or not execution of image formation has been instructed. For example, in a case where a copy execution has been instructed from an operating unit (omitted from illustration) or a print execution has been instructed from a host computer, the CPU 800 advances the processing to step S1802. The CPU 800 (image formation control unit 806) starts image formation operations in step S1802. The image formation control unit 806 executes initial adjustment, and controls the image forming units 5*y*, 5*m*, 5*c*, and 5*bk* including the photosensitive drums 10, and the intermediate transfer belt 24 to an image formation executable state. The image formation control unit 806 controls the exposing devices 22 based on image data input from an image scanner or host computer, to form electrostatic latent images. Note that electrostatic latent images are converted into toner images following the above-described procedures. The toner images are transferred from the photosensitive drums 10 to the intermediate transfer belt 24. The toner image is then transferred from the intermediate transfer belt 24 to the sheet P. The fixing unit 27 fixes the toner image onto the sheet P.

In step S1803, the CPU 800 (load measuring unit 801) determines whether or not rotation torque measurement conditions are satisfied. The CPU 800 (load measuring unit 801) determines that measurement conditions have been satisfied in a case where, for example, the number of sheets on which images have been formed (number of formed images) after the previous measurement timing has reached a predetermined number. The predetermined number here is 200 sheets, for example. Note that the predetermined number may differ for each model of the image forming apparatus 100. Accordingly, the predetermined number may be decided by simulation or experimentation or the like, and be stored in the storage device 850 of the image forming apparatus 100 beforehand. If measurement conditions are not satisfied, the CPU 800 advances the processing to step S1804.

In step S1804, the CPU 800 (image formation control unit 806) determines whether or not image formation has ended. For example, in a case where images are to be formed on X sheets, the CPU 800 (image formation control unit 806) determines whether or not images have been formed on all X sheets. If image formation has not been completed, the CPU 800 transitions the processing to step S1803. On the other hand, if image formation has been completed, the CPU 800 transitions the processing to step S1805.

In step S1805, the CPU 800 (load measuring unit 801) measures rotation torque in a state while the developing sleeve 8 is being driven by the motor M2, while post rotation is being executed. The load measuring unit 801 detects the duty of PWM signals supplied to the motor M3 as rotation torque, as described above. Post rotation is an operation where the photosensitive drum 10 and intermediate transfer belt 24 are rotated for a certain period even after image formation is ended. Note that during post rotation, driving is stopped in the order of exposing device 22, developing sleeve 8, power source unit 2, power source unit 3, charger 21, photosensitive drum 10, and intermediate transfer belt 24. Measurement processing is executed during the period from driving of the exposing device 22 being stopped to driving of the power source unit 2 being stopped. If the developing sleeve 8 is rotating, toner in the developing unit 1 is being borne by the developing sleeve 8. Accordingly, minute amounts of toner are being supplied to the photosensitive drum 10 even if the photosensitive drum 10 is not being exposed. Toner adhering to an unexposed region of the surface of the photosensitive drum 10 is referred to as "development-fogged toner". Note that the power source unit 2 may be stopped or may be running. The amount of development-fogged toner in a state where the power source unit 2 is supplying developing bias is greater than the amount of development-fogged toner in a state where the power source unit 2 is not supplying developing bias. However, supply of developing bias is not indispensable. In the same way, supply of charging bias and transfer bias may be stopped.

The CPU 800 (load measuring unit 801) stops rotation of the developing sleeve 8 in step S1806. That is to say, rotation of the motor M2 is stopped. In step S1807, the CPU 800 (load measuring unit 801) measures the rotation torque in the non-driven state (second state) where the developing sleeve 8 is not rotating. The load measuring unit 801 detects the duty of PWM signals supplied to the motor M3, as rotation torque. The difference calculating unit 802 calculates the difference between the PWM duty (PWMduty1) in the driven state (first state) and the PWM duty (PWMduty2) in the non-driven state (second state). The load measuring unit 801 may store the difference in the storage device 850 as difference data 852. Alternatively, the load measuring unit 801 may store the PWM duty (PWMduty1 and PWMduty2) in the storage device 850 as it is. The difference calculating unit 802 may read the PWM duty (PWMduty1 and PWMduty2) out from the storage device 850 and calculate the difference. The CPU 800 stores the number of images formed at the time of having measured the PWM duty in the storage device 850. The number of images formed may be used to determine whether or not the measurement conditions are satisfied in step S1803. The CPU 800 may determine whether the difference between the current number of images formed and the number of images formed stored in the storage device 850 is a predetermined number of greater.

If measurement conditions are not satisfied in step S1803, the CPU 800 transitions the processing to step S1810. In step S1810, the CPU 800 (image formation control unit 806) interrupts image forming operations. In step S1811, the CPU 800 (load measuring unit 801) measures rotation torque (PWM duty) in a state where the developing sleeve 8 is being rotated. In step S1812, the CPU 800 (load measuring unit 801) stops rotation of the developing sleeve 8. In step S1813, the CPU 800 (load measuring unit 801) measures rotation torque (PWM duty) in a non-driven state. The difference calculating unit 802 may calculate the difference between the PWM duty (PWMduty1) in the driven state (first state) and the PWM duty (PWMduty2) in the non-driven state (second state) at this stage. The difference may be stored in the storage device 850 as difference data 852. The PWM duty (PWMduty1 and PWMduty2) may be stored in the storage device 850 as it is. The CPU 800 (image formation control unit 806) resumes image forming operations in step S1814.

Color Registration Adjustment and Adjustment Processing

Figure 19:
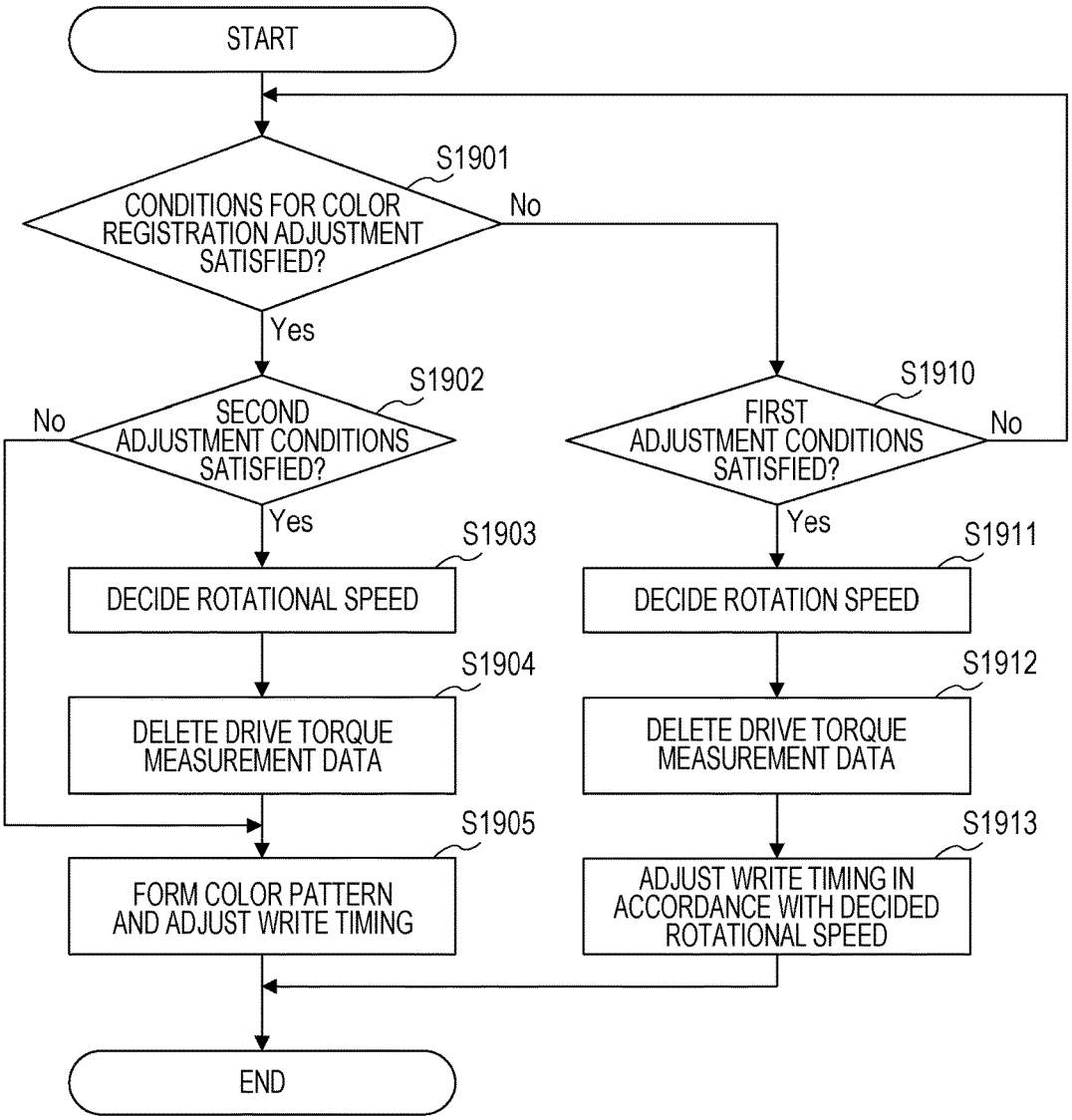
FIG. 19 is a flowchart illustrating a modification of target speed adjustment processing.

FIG. 19 is a flowchart illustrating color registration adjustment and adjustment processing. Although executing color registration adjustment and adjustment processing together is not indispensable, the two will be described together here.

In step S1901, the CPU 800 (third determining unit 813) determines whether or not execution conditions for color registration adjustment are satisfied. If execution conditions for color registration adjustment are satisfied, the CPU 800 transitions the processing to step S1902. An example of execution conditions for color registration adjustment being satisfied is a case where the operator instructs execution of color registration adjustment, or a case where the number of images formed has reached a predetermined number (e.g., 1000).

In step S1902, the CPU 800 (second determining unit 812) determines whether or not second adjustment conditions, which are conditions for executing rotation speed adjustment processing of the photosensitive drum 10, are satisfied. The CPU 800 (second determining unit 812) determines that second adjustment conditions are satisfied in a case where the average value of M sets of difference data saved in the storage device 850 is equal to or exceeds a second threshold value. The second threshold value is, for example, 2%. This is to facilitate execution of adjustment processing when color registration adjustment is being performed. If the second adjustment conditions are not satisfied, the CPU 800 transitions the processing to step S1905, to perform only color registration adjustment. Note that the CPU 800 transitions the processing to step S1905 if the number of difference data 852 stored in the storage device 850 has not reached M.

In step S1905, the CPU 800 (second adjustment unit 822) forms color patterns on the intermediate transfer belt 24, and corrects the write timing for images of each color based on the color pattern detection results. The second adjustment unit 822 controls the image forming units 5*y*, 5*m*, 5*c*, and 5*bk*, via the image formation control unit 806, and forms color patterns on the intermediate transfer belt 24. The second adjustment unit 822 controls the sensor 14 to detect the color patterns, and obtains the amount of positional deviation (color misregistration amount) in the main scan direction and the amount of positional deviation (color misregistration amount) in the sub-scan direction. The second adjustment unit 822 decides the write timing of the images of each color so that the amount of positional deviation is zero, and sets the write timing to the image formation control unit 806. The image formation control unit 806 controls the exposing device 22 based on the write timing. The CPU 800 then ends the color registration adjustment and adjustment processing.

On the other hand, if the second adjustment conditions are satisfied, the CPU 800 advances the processing to step S1903. In step S1903 the CPU 800 (target speed deciding unit 805) decides the rotation speed of the photosensitive drum 10 (speed setting value of the motor M3), based on the rotation torque difference data 852. For example, the target speed deciding unit 805 decides the speed setting value based on the following Expression $$Sd2=Sd1-g\times\Delta\text{PWMduty} \quad (1)$$

where Sd2 represents a newly-decided speed setting value, Sd1 represents the speed setting value used up till now, g represents gain (coefficient) that is decided when shipping from the factory, and ΔPWMduty is rotation torque difference data. The average value of M sets of difference data is substituted into ΔPWMduty here.

In step S1904, the CPU 800 (load measuring unit 801) deletes the M sets of difference data 852 stored in the storage device 850. The M sets of difference data 852 stored in the storage device 850 are data acquired based on the speed setting value before changing (previous speed setting value). Accordingly, the M sets of difference data stored in the storage device 850 are deleted. Thereafter, in step S1905 the CPU 800 executes color registration adjustment (prediction) based on the speed setting value decided in step S1903. This reduces color misregistration in addition to reducing banding.

If execution conditions for color registration adjustment are not satisfied in step S1901, the CPU 800 advances the processing to step S1910. The CPU 800 (first determining unit 811) determines whether or not first adjustment conditions are satisfied in step S1910. First adjustment conditions are conditions for executing rotation speed adjustment processing. The first adjustment conditions are less readily satisfied as compared to the second adjustment conditions. The reason is that the first adjustment conditions are for determining whether or not emergency speed adjustment has become necessary due to sudden rise in the temperature in the apparatus. If the average value of the newest N sets of difference data, out of the M sets of difference data stored in the storage device 850, is equal to or exceeds the first threshold value, the CPU 800 (first determining unit 811) determines that the first adjustment conditions have been satisfied. The first threshold value is, for example, 10%. The first threshold value (e.g., 10%) is set to a larger value than the second threshold value (e.g., 2%). If the first adjustment conditions are not satisfied, the CPU 800 advances the processing to step S1901. The CPU 800 also advances the processing to step S1901 in a case where the number of difference data 852 stored in the storage device 850 has not reached N. On the other hand, the CPU 800 advances the processing to step S1911 if the first adjustment conditions are satisfied.

In step S1911, the CPU 800 (target speed deciding unit 805) decides the rotation speed of the photosensitive drum 10 (speed setting value for the motor M3) based on the rotation torque difference data 852. This deciding processing is the same as the processing in step S1903. In step S1912, the CPU 800 (load measuring unit 801) deletes the M sets of difference data stored in the storage device 850.

In step S1913, the CPU 800 (first adjustment unit 821) decides the write timing based on the newly-decided rotation speed (speed setting value). The image formation position in the sub-scanning direction shifts in accordance in the amount of change to the rotation speed. Accordingly, the write timing is corrected in accordance with the amount of change in rotation speed. The correction amount dt for the write timing can be calculated from, for example, the following Expression $$dt=X/(\omega 2\times D)-X/(\omega 1\times D) \quad (2)$$

where X represents the distance from the exposure position on the surface (circumferential surface) of the photosensitive drum 10 to the nip portion, D represents the diameter of the photosensitive drum 10, ω1 represents the angular velocity corresponding to the speed setting value Sd1 before correction, and ω2 represents the angular velocity corresponding to the speed setting value Sd2 after correction. The CPU 800 then ends the color registration adjustment and adjustment processing.

The image forming apparatus 100 according to the third embodiment adjusts the rotation speed of the photosensitive drum 10 not only at the timing of executing color registration adjustment, but also when the rotation torque difference has suddenly increased. Accordingly, the image forming apparatus 100 appropriately adjusts the rotation speed of the photosensitive drum 10 even in cases where temperature in the apparatus suddenly rises. Thus, according to the image forming apparatus 100, occurrence of banding can be reduced even in a case where temperature in the apparatus suddenly rises.

Figure 20A:
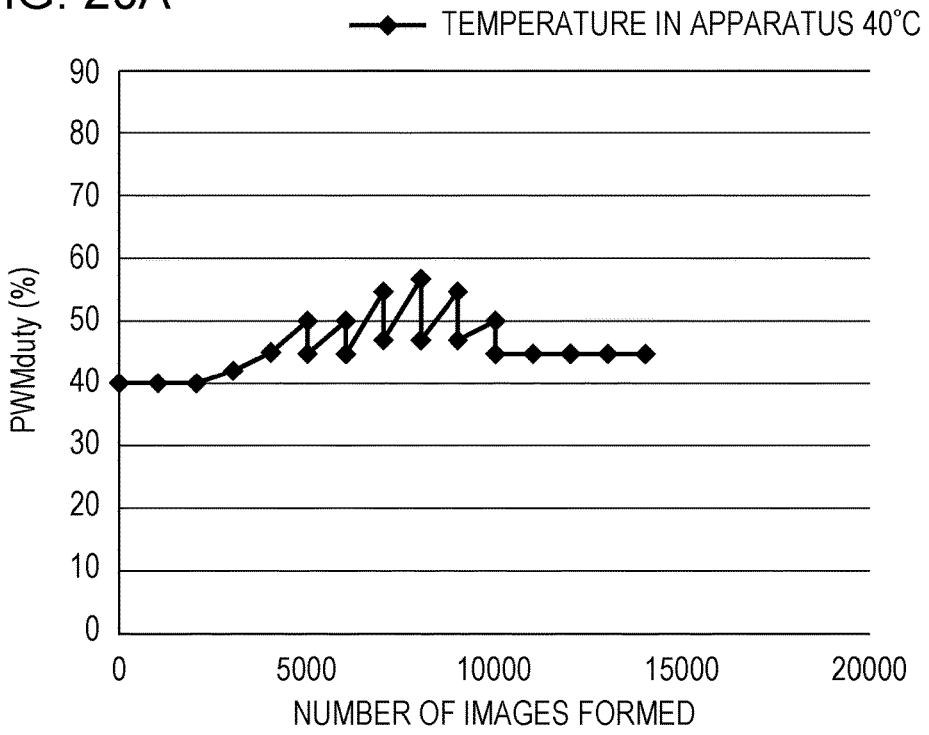
FIGS. 20A and 20B are diagrams exemplifying measurement results of number of images formed and motor PWM signal values.
Figure 20B:
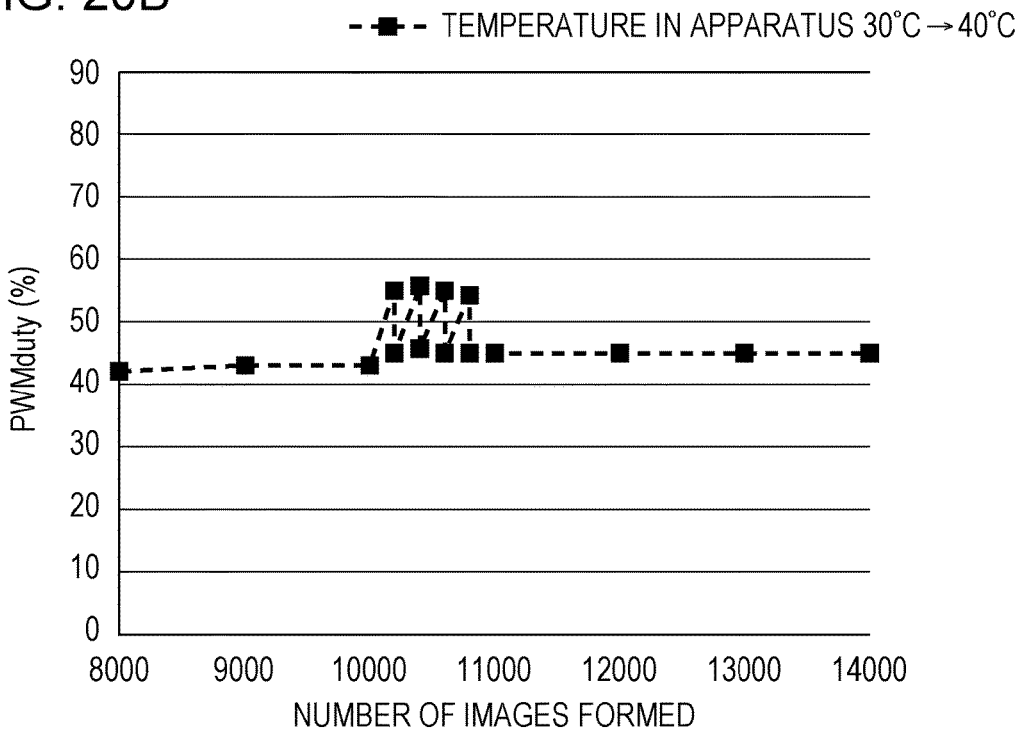

FIGS. 20A and 20B are diagrams for describing the effects of the image forming apparatus 100 according to the third embodiment. FIG. 20A corresponds to the state illustrated in FIG. 16A, where the temperature in the apparatus is high. When the temperature in the apparatus is 40° C., rise in frictional force relating to the photosensitive drum 10 gradually advances. Accordingly, the PWM duty also gradually increases. In this case, the second adjustment conditions are satisfied in step S1902, and the rotation speed is adjusted. That is to say, adjustment of rotation speed and color registration adjustment are executed every predetermined number of sheets (e.g., 1000 sheets). This suppresses increase in PWM duty, thereby suppressing color misregistration and banding from occurring.

FIG. 20B corresponds to the state illustrated in FIG. 16B, where the temperature in the apparatus is low, and then partway through the image forming mode is switched. In this example, the mode is switched from plain paper mode to thick paper mode when the number of images formed reaches 10,000. As a result, the temperature in the apparatus suddenly rises from 30° C. to 40° C. Under such conditions, the PWM duty will rise markedly before the second adjustment conditions are satisfied. The image forming apparatus 100 according to the present embodiment executes adjustment of rotation speed and color registration adjustment under these conditions as well, since the first adjustment conditions are satisfied. This suppresses increase in PWM duty, thereby suppressing color misregistration and banding from occurring.

Although description has been made in the above embodiment that the rotational torque of the motor M3 is detected, the rotational torque of the motor M4 of the intermediate transfer belt 24 may be detected. The photosensitive drum 10 and intermediate transfer belt 24 rotate in contact with each other. Accordingly, rise in frictional force of the photosensitive drum 10 is reflected in the rotation torque of the motor M4 as well. In this case, the first adjustment conditions and second adjustment conditions are changed into conditions using the rotation torque of the motor M4. Note that the rotation speed of the motors M3 for each color may be changed in accordance with the rotation torque of the motor M4 measured by the load measuring unit 801. Alternatively, the rotation speed of the motor M4 may be changed in accordance with the rotation torque of the motor M4 measured by the load measuring unit 801. This is because occurrence of image defects can be suppressed by the difference between the circumferential speed of the photosensitive drum 10 and the circumferential speed of the intermediate transfer belt 24 ultimately coming to a predetermined value.

The first determining unit 811 is an example of a determination unit that determines whether or not a statistics value (e.g., moving mean, etc.) of differences stored in the storage device 850 (or differences obtained from first information and second information that are stored) is equal to or exceeds the first threshold value (e.g., 10%). When the statistics value reaches or exceeds the first threshold value, the target speed deciding unit 805 decides a setting value for the rotation speed of the motor M3 in accordance with the statistics value of the difference, so that the difference is reduced, which has been described with regard to steps S1910 and S1911.

According to the present embodiment, the circumferential speed of the photosensitive drum 10 as to the circumferential speed of the intermediate transfer belt 24 can be adjusted at a more appropriate timing. Accordingly, rotation speed is adjusted at a more appropriate timing.

The target speed deciding unit 805 changes the rotation speed setting value in a case where the operation conditions of the second adjustment unit 822 have been satisfied, and also the statistics value of the load parameter is equal to or exceeds the second threshold value. Even if the operation conditions of the second adjustment unit 822 are not satisfied, the target speed deciding unit 805 changes the setting value if the statistics value of the load parameter is equal to or exceeds the first threshold value that is greater than the second threshold value. Accordingly, the circumferential speed of the photosensitive drum 10 as to the circumferential speed of the intermediate transfer belt 24 can be adjusted at a more appropriate timing.

The load measuring unit 801 may store difference data in the storage device 850 each time the number of sheets on which the image forming apparatus 100 has formed toner images reaches a predetermined number. The image forming apparatus 100 according to the present embodiment execute measurement and acquisition of rotation torque in post rotation as well, so sudden rise in rotation torque is readily detected.

The first statistics unit 803 may obtain the newest N differences from the newest N sets of first information and the newest N sets of second information stored in the storage device 850. The first determining unit 811 determines whether or not the average value of the newest N sets of difference data 852 is equal to or exceeds the first threshold value. Statistical process such as a moving mean or the like is effective in reducing the influence of variance in measurement results. The average value of the newest N differences is used in the present embodiment, thereby enabling reduction in variance in measurement results and detection of sudden rise in rotation torque to be realized.

In a case where execution conditions are satisfied, the second adjustment unit 822 executes color registration adjustment. That is to say, the second adjustment unit 822 controls the image forming units 5*y*, 5*m*, 5*c*, and 5*bk*, to form color patterns 48*y*, 48*m*, 48*c*, and 48*bk*. The second adjustment unit 822 then controls the sensor 14 to detect the color patterns, and adjusts the write timing based on the color misregistration amount. In a case where execution conditions are satisfied, the first adjustment unit 812 determines whether or not the average value of M differences is equal to or exceeds the second threshold value. In a case where the average value of M differences is equal to or exceeds the second threshold value, the target speed deciding unit 805 decides the setting value of rotation speed of the motor M3, based on the average value of M differences, so that the difference is reduced.

Note that after the setting value for the rotation speed of the motor M3 has been changed to the setting value decided by the target speed deciding unit 805, the second adjustment unit 822 adjusts the write timing based on the color misregistration amount of the color patterns. The color misregistration amount changes when the rotation speed is changed. Accordingly, the image forming apparatus 100 can correct color misregistration more accurately by executing color registration adjustment after the rotation speed has been changed.

According to the image forming apparatus 100 of the present embodiment, downtime generated by deciding the target speed of the photosensitive drums 10 can be suppressed. Further, according to the image forming apparatus 100 of the present embodiment, occurrence of image defects can be suppressed even in a case where frictional force between the photosensitive drum 10 and the intermediate transfer belt 24 suddenly rises.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-137955 filed Jul. 12, 2016, Japanese Patent Application No. 2016-138748 filed Jul. 13, 2016, and Japanese Patent Application No. 2016-138754 filed Jul. 13, 2016, which are hereby incorporated by reference herein in their entirety.

What is claimed is:

1. An image forming apparatus that forms an image on a sheet, the image forming apparatus comprising:

an image forming unit including a photosensitive member, and a developer bearing member configured to rotate, and bear a developing agent, and configured to form the image on the photosensitive member using the developing agent on the developer bearing member;

an intermediate transfer member onto which the image is transferred;

a primary transfer member configured to transfer the image from the photosensitive member onto the intermediate transfer member;

a secondary transfer member configured to transfer the image from the intermediate transfer member onto the sheet;

a photosensitive member motor configured to rotate the photosensitive member;

an intermediate transfer member motor configured to rotate the intermediate transfer member;

a controller configured to:

control the photosensitive member motor so that a rotation speed of the photosensitive member is a photosensitive member target rotation speed;

control the intermediate transfer member motor so that a rotation speed of the intermediate transfer member is an intermediate transfer member target rotation speed;

acquire information related to a load of the photosensitive member motor in a period where the photosensitive member and the intermediate transfer member are rotated without rotating the developer bearing member; and control the photosensitive member target rotation speed based on the information, wherein, in a case where a predetermined condition is satisfied while the plurality of images are continuously formed by the image forming unit, the controller stops rotation of the developer bearing member to acquire the information.

2. The image forming apparatus according to claim 1, wherein the controller controls a transfer bias of the primary transfer member, and wherein the controller acquires the information while the controller controls the transfer bias based on a predetermined bias.

3. The image forming apparatus according to claim 1, wherein the controller executes feedback control to control electric current to be supplied to the photosensitive member motor, and wherein the information includes a PWM signal value of the electric current supplied to the photosensitive member motor in the period.

4. The image forming apparatus according to claim 1, wherein the controller acquires another information related to the load of the photosensitive member motor in another period where the photosensitive member, the developer bearing member, and the intermediate transfer member are rotated;

wherein the controller controls the photosensitive member target rotation speed based on the information and the another information.

5. The image forming apparatus according to claim 4, wherein the controller executes feedback control to control electric current to be supplied to the photosensitive member motor, wherein the information includes a PWM signal value of the electric current supplied to the photosensitive member motor in the period, and wherein the another information includes another PWM signal value of the electric current supplied to the photosensitive member motor in the another period.

6. The image forming apparatus according to claim 5, wherein the controller changes the photosensitive member target rotation speed in a case where a difference between the PWM signal value and the another PWM signal value exceeds a threshold value.

7. The image forming apparatus according to claim 1, wherein the predetermined condition includes an usage condition related to usage amount of the image forming unit.

8. The image forming apparatus according to claim 7, wherein the usage condition includes the number of sheets on which the image is formed, and wherein, in a case where the number of sheets on which the image is formed reaches a predetermined number, the predetermined condition is satisfied.

9. The image forming apparatus according to claim 1, wherein the controller performs a color registration adjustment after the photosensitive member target rotation speed is changed.

10. An image forming apparatus that forms an image on a sheet, the image forming apparatus comprising:

a first photosensitive member;

a first exposure unit configured to expose the first photosensitive member to form an electrostatic latent image;

a first developing unit including a first developer bearing member configured to rotate, and bear a developing agent of a first color, and configured to develop the electrostatic latent image on the first photosensitive member using the developing agent on the first developer bearing member, to form a first image;

a second photosensitive member;

a second exposure unit configured to expose the second photosensitive member to form an electrostatic latent image;

a second developing unit including a second developer bearing member configured to rotate, and bear a developing agent of a second color that is different from the first color, and configured to develop the electrostatic latent image on the second photosensitive member using the developing agent on the second developer bearing member, to form a second image;

an intermediate transfer member onto which the first image and the second image are transferred;

a first primary transfer member configured to transfer the first image from the first photosensitive member onto the intermediate transfer member;

a second primary transfer member configured to transfer the second image from the second photosensitive member onto the intermediate transfer member;

a secondary transfer member configured to transfer the first image and the second image from the intermediate transfer member onto the sheet;

a first motor configured to rotate the first photosensitive member;

a second motor configured to rotate the second photosensitive member;

an intermediate transfer member motor configured to rotate the intermediate transfer member;

a controller configured to:

control the first motor so that a rotation speed of the first photosensitive member is a first target rotation speed;

control the second motor so that a rotation speed of the second photosensitive member is a second target rotation speed;

control the intermediate transfer member motor so that a rotation speed of the intermediate transfer member is an intermediate transfer member target rotation speed;

acquire first information related to a load of the first motor in a first period where the first photosensitive member and the intermediate transfer member are rotated without rotating the first developer bearing member;

control the first target rotation speed based on the first information;

acquire second information related to a load of the second motor in a second period where the second photosensitive member and the intermediate transfer member are rotated without rotating the second developer bearing member; and control the second target rotation speed based on the second information, wherein, in a case where a predetermined condition is satisfied while the plurality of images are continuously formed, the controller stops rotation of the first developer bearing member to acquire the first information, and wherein, in a case where the predetermined condition is satisfied while the plurality of images are continuously formed, the controller stops rotation of the second developer bearing member to acquire the second information.

11. The image forming apparatus according to claim 10, wherein the controller controls a first transfer bias of the first primary transfer member, wherein the controller controls a second transfer bias of the second primary transfer member, wherein the controller acquires the first information while the controller controls the first transfer bias based on a predetermined bias, and wherein the controller acquires the second information while the controller controls the first transfer bias based on the predetermined bias.

12. The image forming apparatus according to claim 10, wherein the controller executes feedback control to control electric current to be supplied to the first motor, wherein the controller executes feedback control to control electric current to be supplied to the second motor, wherein the first information includes a first PWM signal value of the electric current supplied to the first motor in the first period, and wherein the second information includes a second PWM signal value of the electric current supplied to the second motor in the second period.

13. The image forming apparatus according to claim 10, wherein the controller acquires a third information related to the load of the first motor in third period where the photosensitive member, the developer bearing member, and the intermediate transfer member are rotated;

wherein the controller controls the first target rotation speed based on the first information and the third information;

wherein the controller acquires a fourth information related to the load of the second motor in fourth period where the photosensitive member, the developer bearing member, and the intermediate transfer member are rotated;

wherein the controller controls the second target rotation speed based on the second information and the fourth information.

14. The image forming apparatus according to claim 13, wherein the controller executes feedback control to control electric current to be supplied to the first motor, and executes feedback control to control electric current to be supplied to the second motor, wherein the first information includes a first PWM signal value of the electric current supplied to the first motor in the first period, wherein the second information includes a second PWM signal value of the electric current supplied to the second motor in the second period, wherein the third information includes a third PWM signal value of the electric current supplied to the first motor in the third period, and wherein the fourth information includes a fourth PWM signal value of the electric current supplied to the second motor in the fourth period.

15. The image forming apparatus according to claim 14, wherein the controller changes the first target rotation speed in a case where a difference between the first PWM signal value and the third PWM signal value exceeds a threshold value, and wherein the controller changes the second target rotation speed in a case where a difference between the second PWM signal value and the fourth PWM signal value exceeds the threshold value.

16. The image forming apparatus according to claim 10, wherein the predetermined condition includes an usage condition related to usage amount of the image forming apparatus.

17. The image forming apparatus according to claim 16, wherein the usage condition includes the number of sheets on which the image is formed, and wherein, in a case where the number of sheets on which the image is formed reaches a predetermined number, the predetermined condition is satisfied.

18. The image forming apparatus according to claim 10, wherein the controller performs a color registration adjustment after the first target rotation speed is changed.

19. The image forming apparatus according to claim 10, wherein the controller performs a color registration adjustment after the second target rotation speed is changed.

20. An image forming apparatus that forms an image on a sheet, the image forming apparatus comprising:

an image forming unit including a photosensitive member, and a developer bearing member configured to rotate, and bear a developing agent, and configured to form the image on the photosensitive member using the developing agent on the developer bearing member;

an intermediate transfer member onto which the image is transferred;

a primary transfer member configured to transfer the image from the photosensitive member onto the intermediate transfer member;

a secondary transfer member configured to transfer the image from the intermediate transfer member onto the sheet;

a photosensitive member motor configured to rotate the photosensitive member;

an intermediate transfer member motor configured to rotate the intermediate transfer member;

a controller configured to:

control the photosensitive member motor so that a rotation speed of the photosensitive member is a photosensitive member target rotation speed;

control the intermediate transfer member motor so that a rotation speed of the intermediate transfer member is an intermediate transfer member target rotation speed;

acquire information related to a load of the intermediate transfer member motor in a period where the photosensitive member and the intermediate transfer member are rotated without rotating the developer bearing member; and control the intermediate transfer member target rotation speed based on the information, wherein, in a case where a predetermined condition is satisfied while the plurality of images are continuously formed by the image forming unit, the controller stops rotation of the developer bearing member to acquire the information.

21. The image forming apparatus according to claim 20, wherein the controller executes feedback control to control electric current to be supplied to the intermediate transfer member motor, and wherein the information includes a PWM signal value of the electric current supplied to the intermediate transfer member motor in the period.

22. The image forming apparatus according to claim 20, wherein the controller acquires another information related to the load of the intermediate transfer member motor in another period where the photosensitive member, the developer bearing member, and the intermediate transfer member are rotated;

wherein the controller controls the intermediate transfer member target rotation speed based on the information and the another information.

23. The image forming apparatus according to claim 22, wherein the controller executes feedback control to control electric current to be supplied to the intermediate transfer member motor, wherein the information includes a PWM signal value of the electric current supplied to the intermediate transfer member motor in the period, and wherein the another information includes another PWM signal value of the electric current supplied to the intermediate transfer member motor in the another period.

24. The image forming apparatus according to claim 20, wherein the predetermined condition includes an usage condition related to usage amount of the image forming unit.

25. The image forming apparatus according to claim 24, wherein the usage condition includes the number of sheets on which the image is formed, and wherein, in a case where the number of sheets on which the image is formed reaches a predetermined number, the predetermined condition is satisfied.

26. An image forming apparatus that forms an image on a sheet, the image forming apparatus comprising:

an image forming unit including a photosensitive member, and a developer bearing member configured to rotate, and bear a developing agent, and configured to form the image on the photosensitive member using the developing agent on the developer bearing member;

an intermediate transfer member onto which the image is transferred;

a primary transfer member configured to transfer the image from the photosensitive member onto the intermediate transfer member;

a secondary transfer member configured to transfer the image from the intermediate transfer member onto the sheet;

a photosensitive member motor configured to rotate the photosensitive member;

an intermediate transfer member motor configured to rotate the intermediate transfer member;

a controller configured to:

control the photosensitive member motor so that a rotation speed of the photosensitive member is a photosensitive member target rotation speed;

control the intermediate transfer member motor so that a rotation speed of the intermediate transfer member is an intermediate transfer member target rotation speed;

acquire information related to a load of the intermediate transfer member motor in a period where the photosensitive member and the intermediate transfer member are rotated without rotating the developer bearing member; and control the photosensitive member target rotation speed based on the information, wherein, in a case where a predetermined condition is satisfied while the plurality of images are continuously formed by the image forming unit, the controller stops rotation of the developer bearing member to acquire the information.

27. The image forming apparatus according to claim 26, wherein the controller executes feedback control to control electric current to be supplied to the intermediate transfer member motor, and wherein the information includes a PWM signal value of the electric current supplied to the intermediate transfer member motor in the period.

28. The image forming apparatus according to claim 26, wherein the controller acquires another information related to the load of the intermediate transfer member motor in another period where the photosensitive member, the developer bearing member, and the intermediate transfer member are rotated;

wherein the controller controls the photosensitive member target rotation speed based on the information and the another information.

29. The image forming apparatus according to claim 28, wherein the controller executes feedback control to control electric current to be supplied to the intermediate transfer member motor, wherein the information includes a PWM signal value of the electric current supplied to the intermediate transfer member motor in the period, and wherein the another information includes another PWM signal value of the electric current supplied to the intermediate transfer member motor in the another period.

30. The image forming apparatus according to claim 26, wherein the predetermined condition includes an usage condition related to usage amount of the image forming unit.

31. The image forming apparatus according to claim 26, wherein the usage condition includes the number of sheets on which the image is formed, and wherein, in a case where the number of sheets on which the image is formed reaches a predetermined number, the predetermined condition is satisfied.

32. An image forming apparatus that forms an image on a sheet, the image forming apparatus comprising:

a first photosensitive member;

a first exposure unit configured to expose the first photosensitive member to form an electrostatic latent image;

a first developing unit including a first developer bearing member configured to rotate, and bear a developing agent of a first color, and configured to develop the electrostatic latent image on the first photosensitive member using the developing agent on the first developer bearing member, to form a first image;

a second photosensitive member;

a second exposure unit configured to expose the second photosensitive member to form an electrostatic latent image;

a second developing unit including a second developer bearing member configured to rotate, and bear a developing agent of a second color that is different from the first color, and configured to develop the electrostatic latent image on the second photosensitive member using the developing agent on the second developer bearing member, to form a second image;

an intermediate transfer member onto which the first image and the second image are transferred;

a first primary transfer member configured to transfer the first image from the first photosensitive member onto the intermediate transfer member;

a second primary transfer member configured to transfer the second image from the second photosensitive member onto the intermediate transfer member;

a secondary transfer member configured to transfer the first image and the second image from the intermediate transfer member onto the sheet;

a first motor configured to rotate the first photosensitive member;

a second motor configured to rotate the second photosensitive member;

an intermediate transfer member motor configured to rotate the intermediate transfer member;

a controller configured to:

control the first motor so that a rotation speed of the first photosensitive member is a first target rotation speed;

control the second motor so that a rotation speed of the second photosensitive member is a second target rotation speed;

control the intermediate transfer member motor so that a rotation speed of the intermediate transfer member is an intermediate transfer member target rotation speed;

acquire information related to a load of the intermediate transfer member motor in a period where the first photosensitive member and the intermediate transfer member are rotated without rotating the first developer bearing member;

control the first target rotation speed based on the information;

control the second target rotation speed based on the information, wherein, in a case where a predetermined condition is satisfied while the plurality of images are continuously formed, the controller stops rotation of the first developer bearing member to acquire the information.

33. The image forming apparatus according to claim 32, wherein the controller executes feedback control to control electric current to be supplied to the intermediate transfer member motor, and wherein the information includes a PWM signal value of the electric current supplied to the intermediate transfer member motor in the period.

34. The image forming apparatus according to claim 32, wherein the controller acquires another information related to the load of the intermediate transfer member motor in another period where the photosensitive member, the developer bearing member, and the intermediate transfer member are rotated;

wherein the controller controls the first target rotation speed based on the information and the another information, wherein the controller controls the second target rotation speed based on the information and the another information.

35. The image forming apparatus according to claim 34, wherein the controller executes feedback control to control electric current to be supplied to the intermediate transfer member motor, wherein the information includes a PWM signal value of the electric current supplied to the intermediate transfer member motor in the period, and wherein the another information includes another PWM signal value of the electric current supplied to the intermediate transfer member motor in the another period.

36. The image forming apparatus according to claim 32, wherein the predetermined condition includes an usage condition related to usage amount of the image forming unit.

37. The image forming apparatus according to claim 36, wherein the usage condition includes the number of sheets on which the image is formed, and wherein, in a case where the number of sheets on which the image is formed reaches a predetermined number, the predetermined condition is satisfied.

* * * * *